US007833118B2

(12) United States Patent
Severa et al.

(10) Patent No.: US 7,833,118 B2
(45) Date of Patent: Nov. 16, 2010

(54) RACQUET STRINGING MACHINE

(75) Inventors: William D. Severa, Darien, IL (US); Ronald R. Rocchi, Naperville, IL (US); John B. Lyons, Wilmette, IL (US); Robert T. Kapheim, Elmhurst, IL (US); Daniel R. Nett, Sun Prairie, WI (US); Craig P. Conner, Madison, WI (US)

(73) Assignee: Wilson Sporting Goods Co., Chicago, IL (US)

( * ) Notice: Subject to any disclaimer, the term of this patent is extended or adjusted under 35 U.S.C. 154(b) by 313 days.

(21) Appl. No.: 12/077,010

(22) Filed: Mar. 14, 2008

(65) Prior Publication Data

US 2008/0254922 A1 Oct. 16, 2008

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS

| | | | | |
|---|---|---|---|---|
| 2,015,238 | A | 9/1935 | Saladino | 273/73 |
| 2,043,813 | A | 6/1936 | Saladino | 273/73 |
| 2,100,948 | A | 11/1937 | Doll | 273/73 |
| 3,988,022 | A | 10/1976 | Halbrook | 583/647 |
| 4,130,278 | A | 12/1978 | Gutzwiller | 808/538 |
| 4,546,977 | A | 10/1985 | Bosworth, Jr. et al. | 273/73 |
| 4,620,705 | A | 11/1986 | Tsuchida | 273/73 |
| 4,706,955 | A | 11/1987 | Ngadi et al. | 273/73 |
| 5,026,055 | A | 6/1991 | Longeat | 273/73 |
| 5,080,360 | A | 1/1992 | Longeat | 273/73 |
| 5,090,697 | A | 2/1992 | Lee | 273/73 |
| 5,186,505 | A | 2/1993 | Chu | 273/73 |
| 5,269,515 | A | 12/1993 | Chu | 273/73 |
| 5,338,028 | A | 8/1994 | Sung | 273/73 |
| 5,568,921 | A | 10/1996 | Lorentzen et al. | 273/73 |
| 5,590,877 | A | 1/1997 | Ho | 473/556 |
| 5,639,086 | A | 6/1997 | Wolverton et al. | 473/555 |
| 5,733,212 | A | 3/1998 | Wise et al. | 473/557 |

(Continued)

FOREIGN PATENT DOCUMENTS

DE 29 15 647 A1 10/1980

(Continued)

OTHER PUBLICATIONS

Owner's manual for Wilson EX-7900W Digital Stringing Machine.

(Continued)

*Primary Examiner*—Raleigh W. Chiu
(74) *Attorney, Agent, or Firm*—Terence P. O'Brien; Melanie I. Rauch

(57) ABSTRACT

An ergonomically-designed racquet stringing machine. The stringing machine includes an electronic control unit coupled to a platform and/or to a height adjustment assembly. The control unit is capable of generating a control signal to automatically adjust at least one parameter of the machine, such as machine height, angle of stringing platform, or string tension, based upon a selected user profile. A method of controlling tension in a racquet while stringing the racquet entails the use of the stringing machine.

23 Claims, 24 Drawing Sheets

U.S. PATENT DOCUMENTS

| | | | | |
|---|---|---|---|---|
| 5,820,500 | A | 10/1998 | Raos | 473/557 |
| 5,908,362 | A | 6/1999 | Carr | 473/557 |
| 6,162,139 | A | 12/2000 | Bassili | 473/557 |
| 6,227,990 | B1 | 5/2001 | Wise et al. | 473/557 |
| 6,398,674 | B2 | 6/2002 | Tsuchida | 473/557 |
| 6,583,590 | B1 * | 6/2003 | Chu | 318/34 |
| 6,712,723 | B2 | 3/2004 | You | 473/555 |
| 6,764,418 | B1 | 7/2004 | Lee | 473/557 |
| 6,837,811 | B1 | 1/2005 | Wu | 473/557 |
| 7,153,226 | B1 * | 12/2006 | Van Der Pols | 473/557 |
| 7,192,370 | B2 * | 3/2007 | van der Pols | 473/557 |
| 7,448,970 | B2 * | 11/2008 | Li | 473/557 |
| 7,455,604 | B2 * | 11/2008 | Li | 473/557 |
| 7,468,011 | B2 * | 12/2008 | Tsuchida | 473/557 |
| 2003/0022740 | A1 | 1/2003 | You | 473/557 |
| 2003/0027670 | A1 * | 2/2003 | van der Pols | 473/557 |
| 2005/0096160 | A1 | 5/2005 | Nakane et al. | 473/557 |
| 2008/0167147 | A1 * | 7/2008 | Li | 473/557 |
| 2008/0214337 | A1 | 9/2008 | Tsuchida | 473/555 |
| 2008/0242454 | A1 * | 10/2008 | Li | 473/556 |
| 2008/0254922 | A1 * | 10/2008 | Severa et al. | 473/556 |
| 2008/0254923 | A1 * | 10/2008 | Severa et al. | 473/557 |
| 2008/0254924 | A1 * | 10/2008 | Severa et al. | 473/557 |

FOREIGN PATENT DOCUMENTS

| | | | | |
|---|---|---|---|---|
| EP | 0136245 | A2 | | 4/1985 |
| EP | 136245 | A2 | * | 4/1985 |
| JP | 2008178435 | A | * | 8/2008 |
| JP | 2008302209 | A | * | 12/2008 |
| JP | 2008302210 | A | * | 12/2008 |
| JP | 2009006121 | A | * | 1/2009 |
| WO | WO 95/29740 | | | 11/1995 |

OTHER PUBLICATIONS

Web pages illustragting Alpha Stringway Stringing Machines Website Information.

* cited by examiner

A
B
C
D
E
FROM FIG. 15A
200
TO / FROM FIG. 15A
FROM FIG. 15C
5'10"
FROM FIG. 15A
E
88.5
%
FROM FIG. 15C
125.8
12°
D
BUZZER
YES
NO
KG LB
%
100%
%
SELECT LINKS
KG
LB

RACQUET STRINGING MACHINE

RELATED U.S. APPLICATION DATA

The present invention claims the benefit of the filing date under 35 U.S.C. §119(e) of U.S. Provisional Patent Application Ser. No. 60/922,938, filed on Apr. 11, 2007, which is hereby incorporated by reference in its entirety.

FIELD OF THE INVENTION

The present invention relates to a machine for stringing racquets. This stringing machine has enhanced ergonomic features to accommodate individuals of various sizes and their personal preferences.

BACKGROUND OF THE INVENTION

The act of stringing a racquet requires a considerable amount of manual labor. Stringing machines assist in the process by maintaining the racquet in place and providing desired tension in the strings, but a majority of the work involved is performed by a person. More particularly, a person must align the racquet within the stringing machine, and then string each of the cross or main strings individually, followed by weaving each of the cross and main strings to form the resulting string grid.

Those in the racquet stringing business often spend many hours a day standing in front of a stringing machine. Conventional stringing machines include a stringing platform with a turntable positioned on top of a fixed stand. The turntable spins within a plane parallel to the floor. Because of the fixed orientation of the stand and the planar position of the turntable, the person stringing the racquet must adjust his or her posture to conform to the position of the stringing machine. Furthermore, the various steps involved in stringing a racquet require the racquet stringer to assume a variety of stances. In particular, one of the racquet stringer's shoulders is often positioned much higher than the other. Also, the fixed orientation of the stringing machine often induces the racquet stringer to hunch over the turntable. The awkward posture induced by conventional stringing machines often causes injuries and fatigue, which ultimately lead to reduced efficiency in the performance of the racquet stringer.

It would thus be desirable to provide a stringing machine that is ergonomically designed to allow users to work with the stringing machine without having to assume awkward or uncomfortable positions. In doing so, it would also be desirable to provide an ergonomically-designed stringing machine that can automatically adjust its orientation to accommodate individuals of various sizes. It would be further desirable for such an ergonomically-designed stringing machine to be adjustable to accommodate personal preferences.

SUMMARY OF THE INVENTION

The present invention presents an ergonomically-designed racquet stringing machine for stringing of a racquet by a user. The racquet stringing machine can be adjusted to accommodate individuals of various sizes and their personal preferences. The stringing machine includes a base configured to support the stringing machine on a generally horizontal surface, a stand extending upwardly from the base, and a stringing platform coupled to an upper region of the stand, with the stringing platform supporting at least one racquet mount for securing the racquet about a stringing plane. The stringing machine may also include an electronic control unit.

In one embodiment, the stringing machine includes a platform tilt assembly coupled to the stringing platform and to the stand, with a control unit coupled to the stringing platform and operably coupled to the platform tilt assembly. In this embodiment, the control unit is capable of generating a first control signal to the platform tilt assembly to adjust the position of the stringing platform and the angle of the stringing plane with respect to the horizontal surface, thereby enabling a user to tilt the stringing platform forward for a more comfortable position during one or more steps of the racquet stringing process. For example, the platform tilt assembly may be configured to adjust the angle of the stringing plane with respect to the horizontal surface by an amount within the range of 0 to 30 degrees, or within the range of 1 to 15 degrees. More particularly, the stringing platform includes a front surface generally facing the user during stringing of the racquet. The platform tilt assembly can adjust the angle of the stringing plane about a generally horizontal pivot axis extending generally parallel to the front surface of the stringing platform.

The platform tilt assembly can include a drive unit configured to reposition an actuator in response to the first control signal from the control unit. In particular, the actuator can be coupled between the stringing platform and the stand, with the actuator extending to rotate the stringing platform about a generally horizontal pivot axis with respect to the stand.

The stringing platform may support a turntable and a string tensioning assembly, with the string tensioning assembly including a string puller head coupled to a puller motor. The turntable and the string puller head can maintain their positions relative to the stringing plane as the stringing platform is tilted by the platform tilt assembly. In certain embodiments, the string puller head may include a self-guiding tension puller having a tapered housing.

Similarly, the stringing machine may include a control assembly housing coupled to the stringing platform, with the control assembly housing being capable of tilting along with the stringing platform. The control assembly housing may be formed primarily of die-cast aluminum. Additionally, the control assembly housing may define a tool storage region that is shaped to retain tools in all stringing plane positions of the stringing machine.

In certain embodiments, the stringing machine may possess a tilted configuration of the stringing platform in which the stringing plane is fixed at an angle of about 1 to about 15 degrees from the horizontal surface. Alternatively, the angle of the stringing plane may be adjusted by manually adjusting a platform tilt assembly coupled to the stringing platform, at an angle of 1 to about 15 degrees from the horizontal surface, for example.

As mentioned above, the stringing machine may include a tool storage region coupled to the stringing platform and designed to hold tools. The tool storage region or tool storage tray may have a bottom surface lying in a plane that is non-parallel with the stringing plane. For example, the bottom surface of the tool storage tray my lie in a plane that is approximately parallel with the horizontal surface while the stringing plane is tilted. As a further example, the bottom surface of the tool storage tray be lie in a plane that is at an angle of about 1 to about 15 degrees from the stringing plane.

The stringing machine may also include at least one string clamps that can be positioned and repositioned within the stringing plane, with each string clamp having an over-molded grip. The over-molded grip may be formed substantially of rubber. This grip provides improved comfort to the user.

The stringing platform may include a turntable rotatable about a generally vertical axis. Additionally, the turntable may include a ring centered about the generally vertical axis, with a releasable resistance assembly configured to releasably engage the ring to prevent rotation of the turntable about the generally vertical axis.

In another embodiment, the stringing machine includes a height adjustment assembly coupled to the stand, the stringing platform, and/or the base, and a control unit operably coupled to the height adjustment assembly. In this embodiment, the control unit is capable of generating a first control signal to the height adjustment assembly to automatically adjust the height of the stringing machine based upon a selected user profile. The height adjustment assembly can adjust the height of the stringing machine in response to the first control signal by a distance within the range of 0.25 inches to 24 inches, for example. More preferably, the height adjustment range can be approximately 11 inches. The height adjustment assembly may include a height adjustment motor coupled to the stand, with the height adjustment motor driving a gear assembly to adjust the height of the stringing machine. The control unit may be capable of storing at least one user profile and automatically adjusting the height of the stringing machine in accordance with the selected stored profile.

In certain embodiments, the stringing machine may include an electronic control unit operably coupled to the stringing platform, wherein the control unit is capable of storing at least one user profile and generating a first control signal to automatically adjust at least one parameter of the machine, such as machine height, angle of stringing platform, or string tension, based upon a selected user profile. In particular, the user profile may include the user's height, a preference for metric or English units, a language preference (English, Spanish, French, German, etc.), tension indication preference (visual, auditory, or both), stringing pattern preference, pre-stretch preference, and/or any other specified preferences. For example, the electronic control unit may adjust the height of the stand based on the user's height.

Other features that the electronic control unit may possess include preferential tension control, such as the capability to adjust the tension in the strings of a racquet while the racquet is being strung in accordance with the user's preference, and/or the capability to maintain tension in cross strings at a different level of tension than in main strings. The electronic control unit may include a display having a touch pad on which a user can adjust tension in the string during one or more steps of the stringing process. Additionally, or alternatively, the electronic control unit may be configured to allow for the automatic machine adjustments to be manually overridden. The electronic control unit may also have the capability to display two or more tension notification signals, such as a visual blinking of lights and an auditory beeping indicator. The user may elect a single tension notification signal of their choice, or any two or more of the signals to be used simultaneously.

Also the electronic control unit may include a USB interface, an SD card interface, an MP3 player interface, one or more speakers, and/or other peripheral capabilities that allow a user to simultaneously employ other electronic devices for listening to music, communicating with others, or the like. The control unit itself may be modular, thereby allowing a user to replace or repair just the control unit, rather than having to either replace the entire machine or send the entire machine to a repair facility. Additionally, the stringing machine may include an external power source operatively attached to the electronic control unit. By locating the power source outside the body of the stringing machine, this configuration may facilitate importation procedures concerning approval of electrical devices.

The invention also presents a method of controlling tension in a racquet while stringing a racquet using a racquet stringing machine as described herein. More particularly, the method includes securing a racquet to the stringing platform of a racquet stringing machine and selecting a stored user profile in an electronic control unit operably coupled to the stringing platform, in response to which the electronic control unit generates a first signal to automatically adjust tension in the string. The user strings main strings in the racquet, guides the string through a tension puller, strings cross strings in the racquet, and again guides the string through the tension puller. The electronic control unit may pre-stretch the string, depending on the user's preferences. As described above, the user may adjust tension in the string by pressing an adjustment indicator on a display operably connected to the electronic control unit.

Any one or more of the stringing machine embodiments and methods described herein may be applied to machines for stringing tennis racquets, racquetball racquets, squash racquets, badminton racquets, and any other strung racquet. Regardless of the type of racquet, compatibility of the stringing machine with the user is greatly improved by using any of the stringing machine enhancements in this invention.

DETAILED DESCRIPTION OF THE INVENTION

Figure 1:
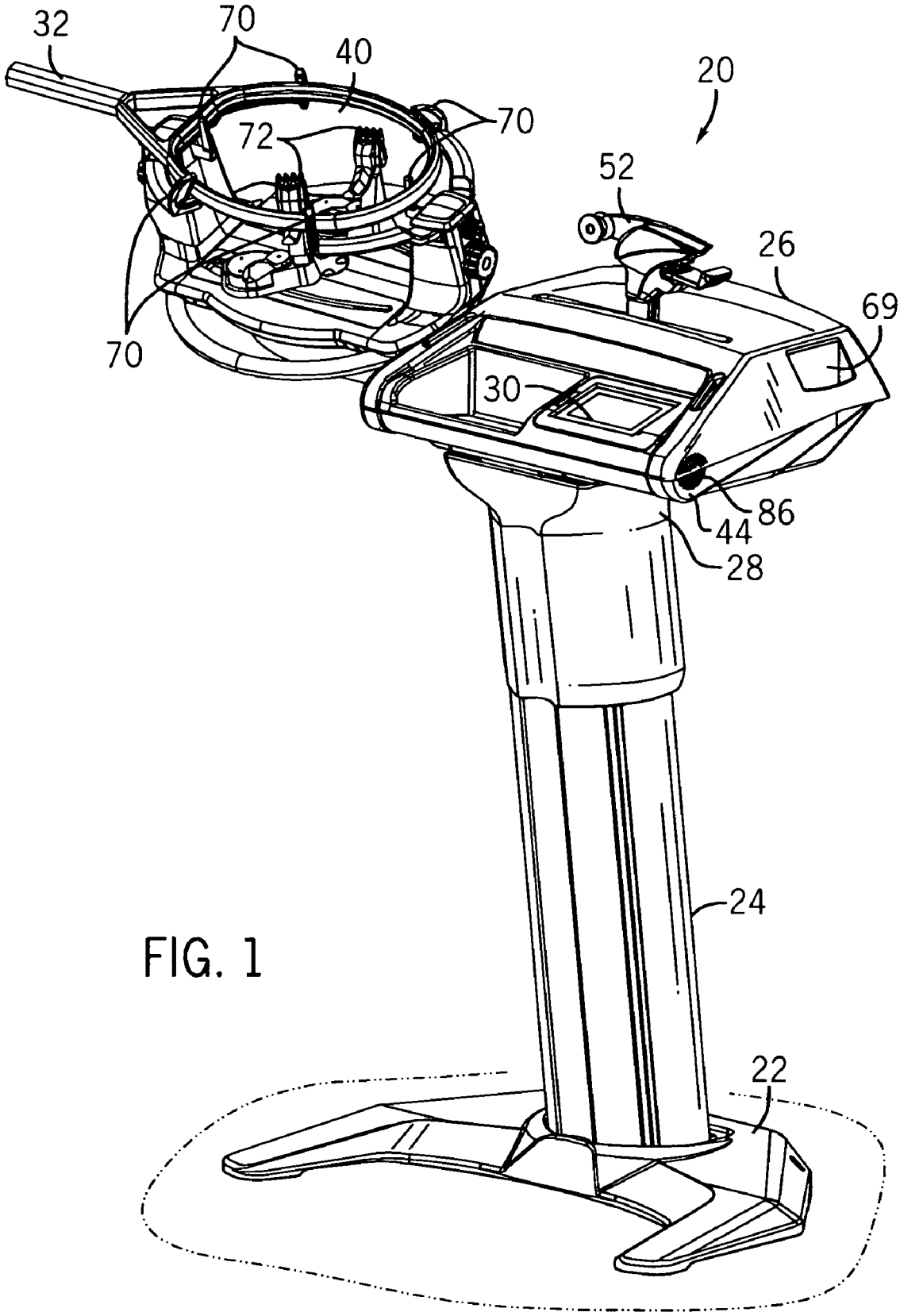
FIG. 1 is a perspective view of a racquet stringing machine.

Referring to FIG. 1, an ergonomically-designed racquet stringing machine is indicated generally at 20. The ergonomic features of the stringing machine 20 are intended to provide enhanced comfort for a user during the process of stringing a racquet 32. In particular, the stringing machine 20 may automatically adjust its orientation to accommodate individuals of various sizes. Additionally or alternatively, the stringing machine 20 may be adjustable to accommodate personal preferences.

Figure 2B:
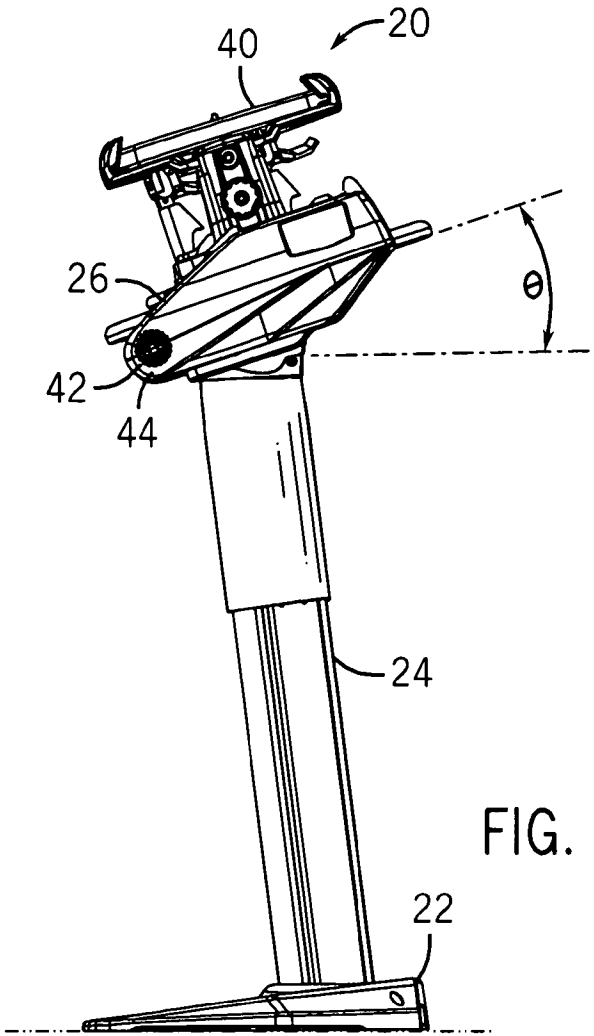
FIGS. 2A and 2B are side views of a racquet stringing machine showing how the angle of the stringing platform can be adjusted.
Figure 2A:
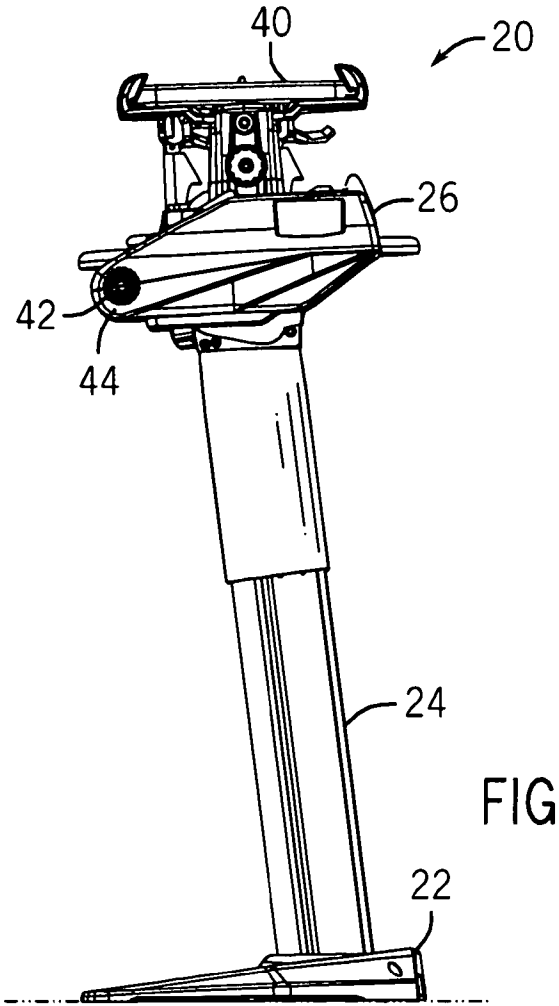

The stringing machine 20 includes a base 22 configured to support the stringing machine 20 on a generally horizontal surface, a stand 24 extending upwardly from the base 22, and a stringing platform 26 coupled to an upper region 28 of the stand 24, with the stringing platform 26 supporting at least one racquet mount 70 for securing the racquet 32 about a stringing plane 40. The base 22 and stand 24 may be a single-leg design, as illustrated in FIGS. 1, 2A, and 2B. Alternatively, a two, three, or four-leg design (not shown) may work equally well. In an alternative preferred embodiment, the stringing machine may be formed without a stand. In this embodiment, the stringing machine can be placed onto a table or other elevated structure. The stringing machine 20 may also include an electronic control unit 30.

Conventional stringing machines 46 (FIGS. 3, 5, and 7) include a stand extending perpendicularly from a base at a fixed height with a stringing platform affixed to the top of the stand, such that the stringing platform remains in a plane essentially parallel to the ground. Although this fixed configuration of the stringing machine may be comfortable for a small percentage of users, the adjustable stringing machine 20 disclosed in this invention provides a comfortable working position to a much wider range of users. For example, in certain embodiments, as illustrated in FIGS. 2A and 2B, the stringing platform 26 can be tilted from 0 to about 30 degrees, or from 1 to about 15 degrees from horizontal from a mounted position atop the stand 24, thereby creating a more comfortable position for a user during various steps of the stringing process. As another example, in certain embodiments, the height of the stand 24 can be raised or lowered by a distance within the range of 0.25 inches to 24 inches, for example, thereby equally accommodating both short users and tall users. In one particularly preferred embodiment the range of height adjustment of the stand is approximately 11 inches, wherein the height of the stringing machine, measured from horizontal to a horizontally positioned string bed (or stringing plane), can range from approximately 40 inches to approximately 51 inches. Other stringing machine height ranges can also be used. These adjustment features are described in greater detail below.

Figure 4:
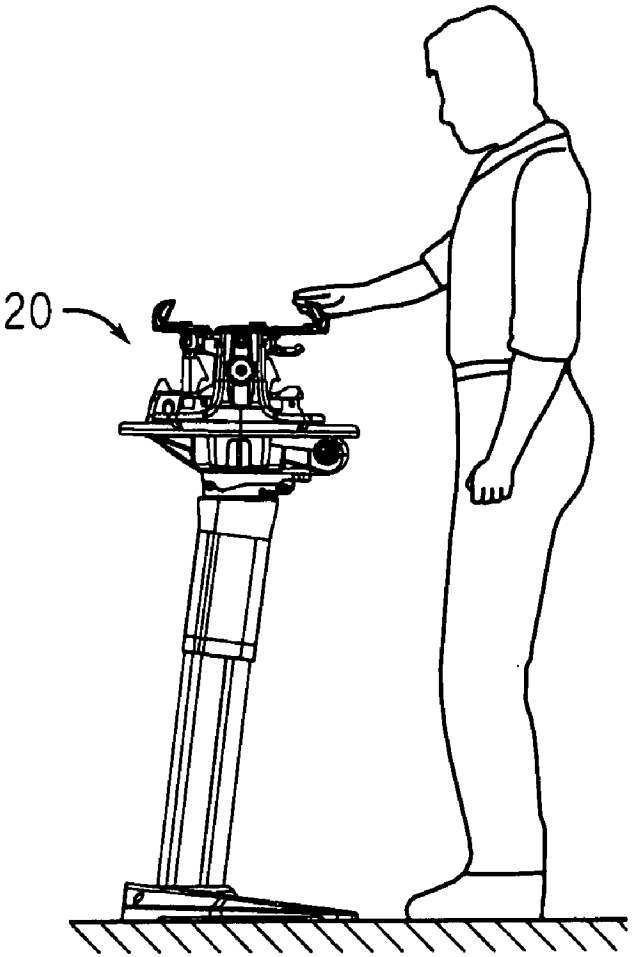
FIG. 4 is a side view of a user in a preferred posture while clamping a racquet on a racquet stringing machine.
Figure 3:
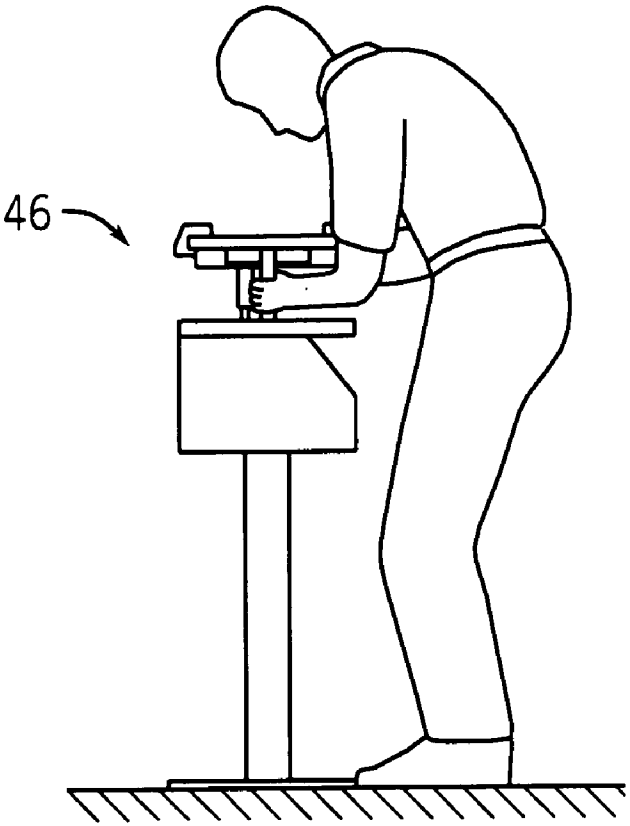
FIG. 3 is a side view of a user in an induced posture while clamping a racquet on a racquet stringing machine.

When stringing a racquet 32, the racquet 32 must first be clamped onto the adjustable stringing platform 26. As illustrated in FIG. 3, conventional stringing machines 46 induce poor posture for many users trying to clamp the racquet onto the stringing platform. By adjusting the height of the stand 24, the height of the stringing platform 26 may be raised or lowered to accommodate the user, thereby preventing the user from hunching over the stringing platform 26, as shown in FIG. 4. Any suitable height-adjusting mechanism can be applied to the stringing machine 20, such as a telescoping height-adjustment mechanism. A more detailed description of height-adjusting mechanisms is provided below.

Figure 6:
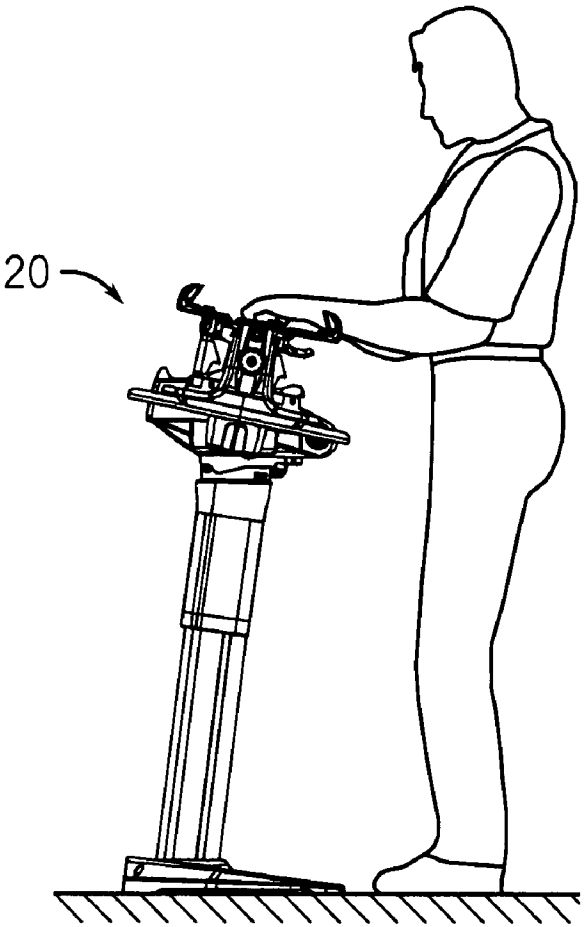
FIG. 6 is a side view of a user in a preferred posture while stringing main strings on a racquet.
Figure 5:
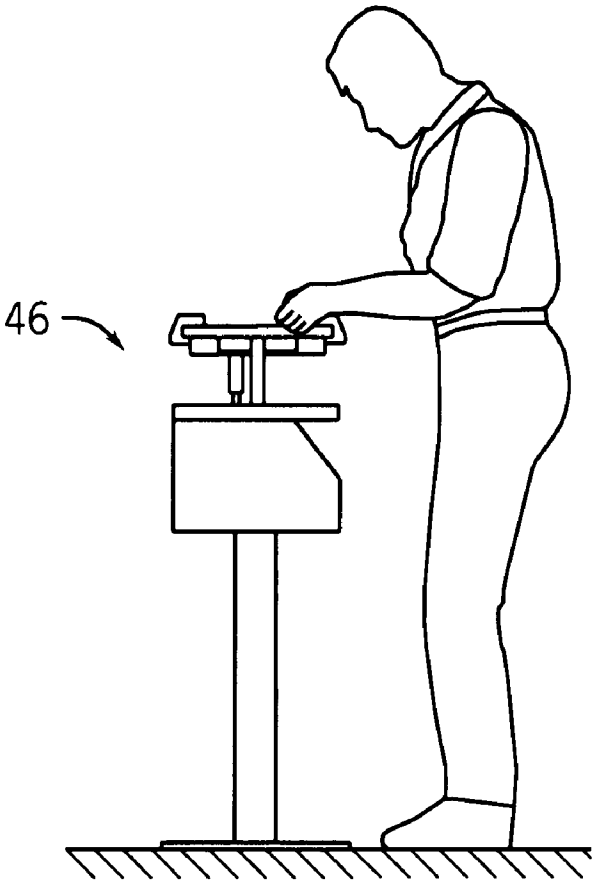
FIG. 5 is a side view of a user in an induced posture while stringing main strings on a racquet.

Additional steps in the stringing process also induce poor posture for many users. As shown in FIG. 5, the process of stringing the main strings may cause neck strain or other discomfort due to the positioning of the stringing platform with respect to the user's position. By adjusting the height of the stand 24 as well as the angle of the stringing platform 26, the position of the stringing platform 26 may be adjusted to accommodate the user, thereby allowing the user to stand upright in a relatively comfortable position, as shown in FIG. 6.

Figure 8:
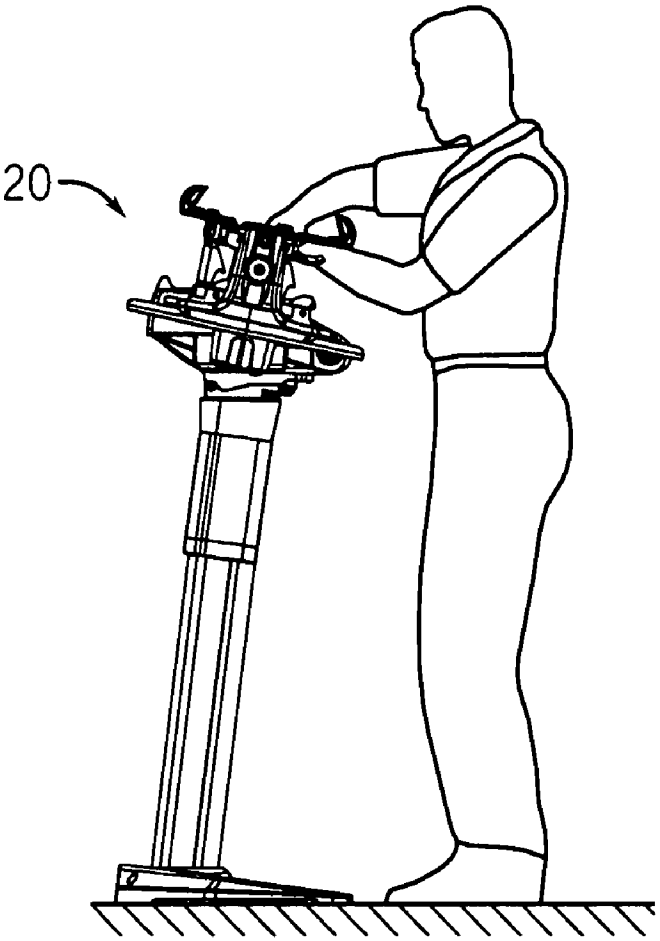
FIG. 8 is a side view of a user in a preferred posture while weaving cross strings on a racquet.
Figure 7:
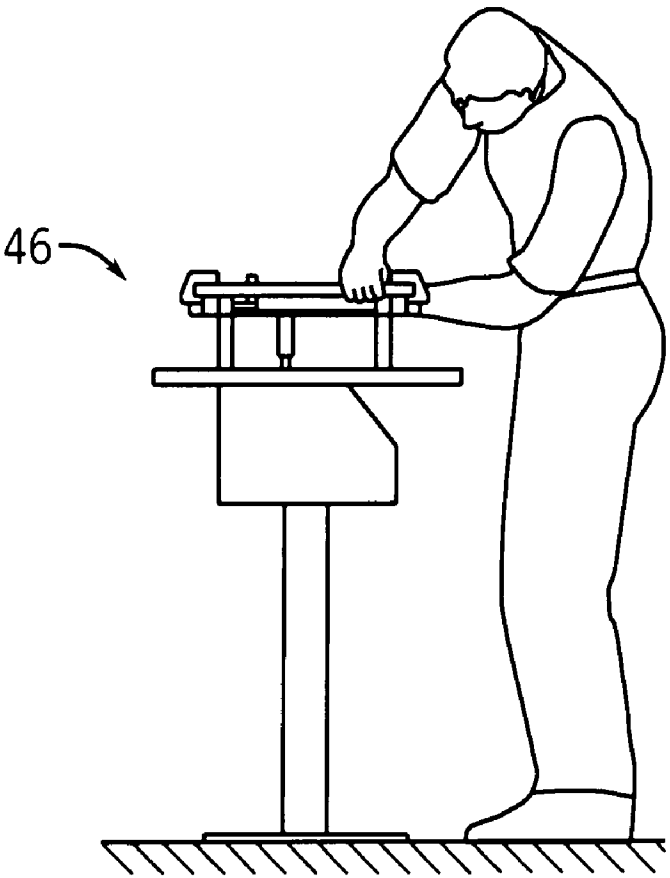
FIG. 7 is a side view of a user in an induced posture while weaving cross strings on a racquet.

Similarly, the detail-oriented process of weaving cross strings may also cause neck strain or other discomfort, as exemplified in FIG. 7. By further adjusting the height of the stand 24 and the angle of the stringing platform 26, the height and angle of the stringing platform 26 can be arranged in a position that allows the user to weave the cross strings in a more ergonomically preferable position, as shown in FIG. 8.

FIG. 2A shows a side view of a stringing machine 20 with the stringing platform 26 in a horizontal position, such that the stringing plane 40 is parallel to the floor, and FIG. 2B shows the same stringing machine 20 with the stringing platform 26 in a tilted position in which the stringing plane 40 is tilted at an angle θ with respect to the horizontal position. The tilting of the stringing platform 26 may be performed by any suitable drive mechanism known to those skilled in the art, as there are many suitable drive mechanisms that would be appropriate for raising and lowering the angle of the stringing platform 26. As explained in greater detail below, an electronic control unit 30 may be used to electronically control the angle θ of the stringing platform 26. However, in certain embodiments, the stringing machine 20 may possess a tilted configuration of the stringing platform 26 in which the stringing plane 40 is fixed at an angle of about 1 to about 15 degrees from the horizontal surface. Alternatively, the angle θ of the stringing plane 40 may be adjusted by manually adjusting a platform tilt assembly coupled to the stringing platform 26, at an angle of 1 to about 15 degrees from the horizontal surface, for example.

In one embodiment, the stringing machine 20 includes a platform tilt assembly 48 coupled to the stringing platform 26 and to the stand 24, with a control unit 30 (see FIGS. 1 and 9-13) coupled to the stringing platform 26 and operably coupled to the platform tilt assembly 48. In this embodiment, the control unit 30 is capable of generating a first control signal to the platform tilt assembly 48 to adjust the position of the stringing platform 26 and the angle θ of the stringing plane 40 with respect to the horizontal surface, thereby enabling a user to tilt the stringing platform 26 forward, as illustrated in FIG. 2, for a more comfortable position during one or more steps of the racquet stringing process. For example, the platform tilt assembly 48 may be configured to adjust the angle θ of the stringing plane 40 with respect to the horizontal surface by an amount within the range of 0 to 30 degrees, or within the range of 1 to 15 degrees. In other embodiments, other angular ranges can be employed. More particularly, the stringing platform 26 includes a front surface 42 generally facing the user during stringing of the racquet 32. The platform tilt assembly 48 can adjust the angle θ of the stringing plane 40 about a generally horizontal pivot axis 44 extending generally parallel to the front surface 42 of the stringing platform 26. The pivot axis 44, as represented in FIG. 2, is perpendicular to the plane in which the drawing lies. The stringing plane 40 is the plane in which a racquet 32 lies when the racquet 32 is clamped to the stringing platform 26.

The platform tilt assembly 48 can include a drive unit 49 configured to reposition an actuator 50 in response to the first control signal from the control unit 30, as illustrated in FIGS.

12A and 12B. In particular, the actuator 50 can be coupled between the stringing platform 26 and the stand 24, with the actuator 50 extending outward from a lower region of a control assembly housing 64. When activated, the actuator 50 pushes against the stand 24, thereby rotating the stringing platform 26 about the generally horizontal pivot axis 44.

As illustrated in FIGS. 9-13, the stringing platform 26 may support a turntable 54 and a string tensioning assembly 52, with the string tensioning assembly 52 including a string puller head 56 coupled to a puller motor 58. The string tensioning assembly 52 pulls the strings to the desired tension during the stringing process. The turntable 54 and the string puller head 56 can maintain their positions relative to the stringing plane 40 as the stringing platform 26 is tilted by the platform tilt assembly.

Figure 11A:
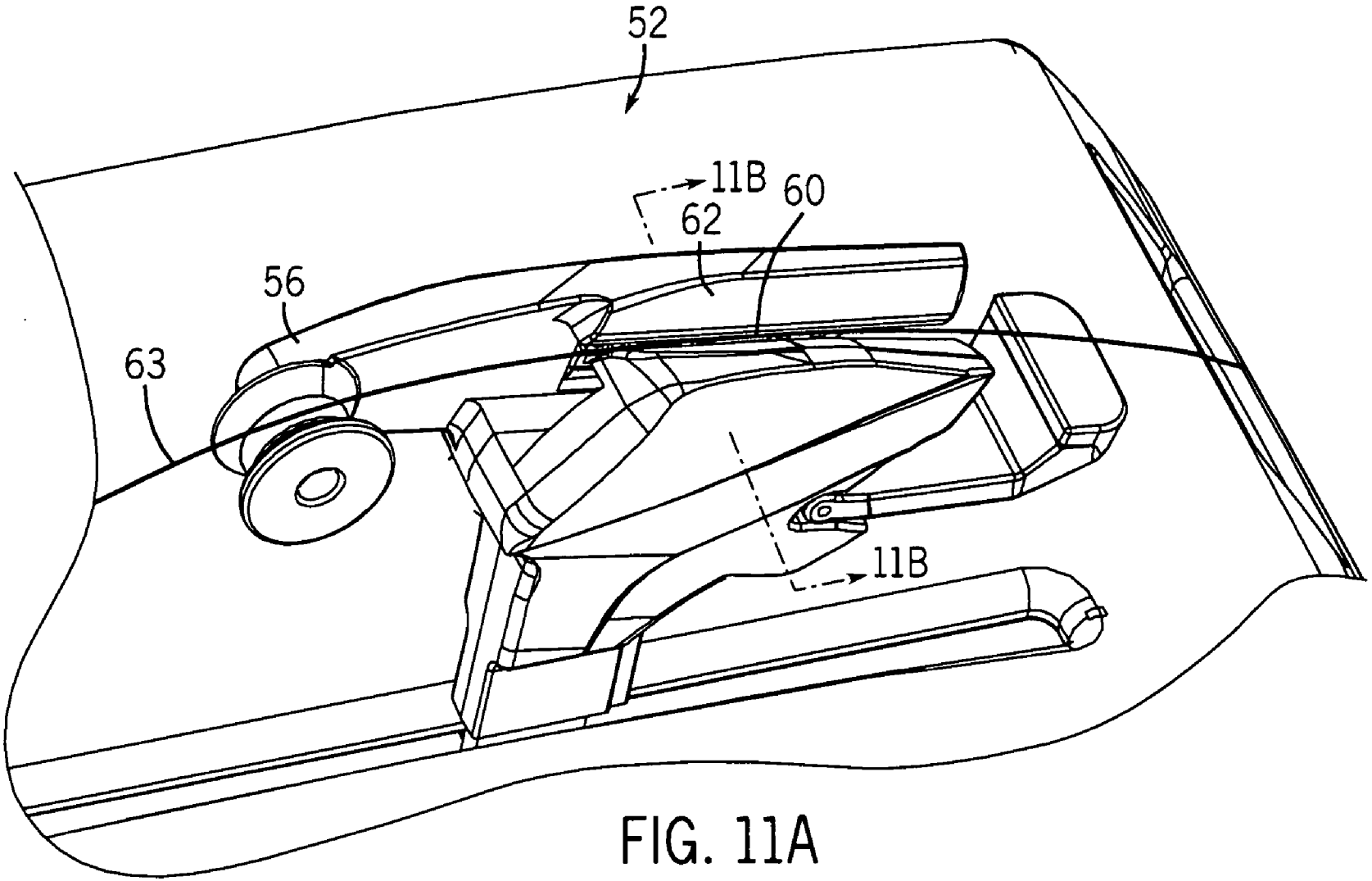
FIG. 11A is a partial view of the string puller head on the stringing platform of FIG. 10.
Figure 11B:
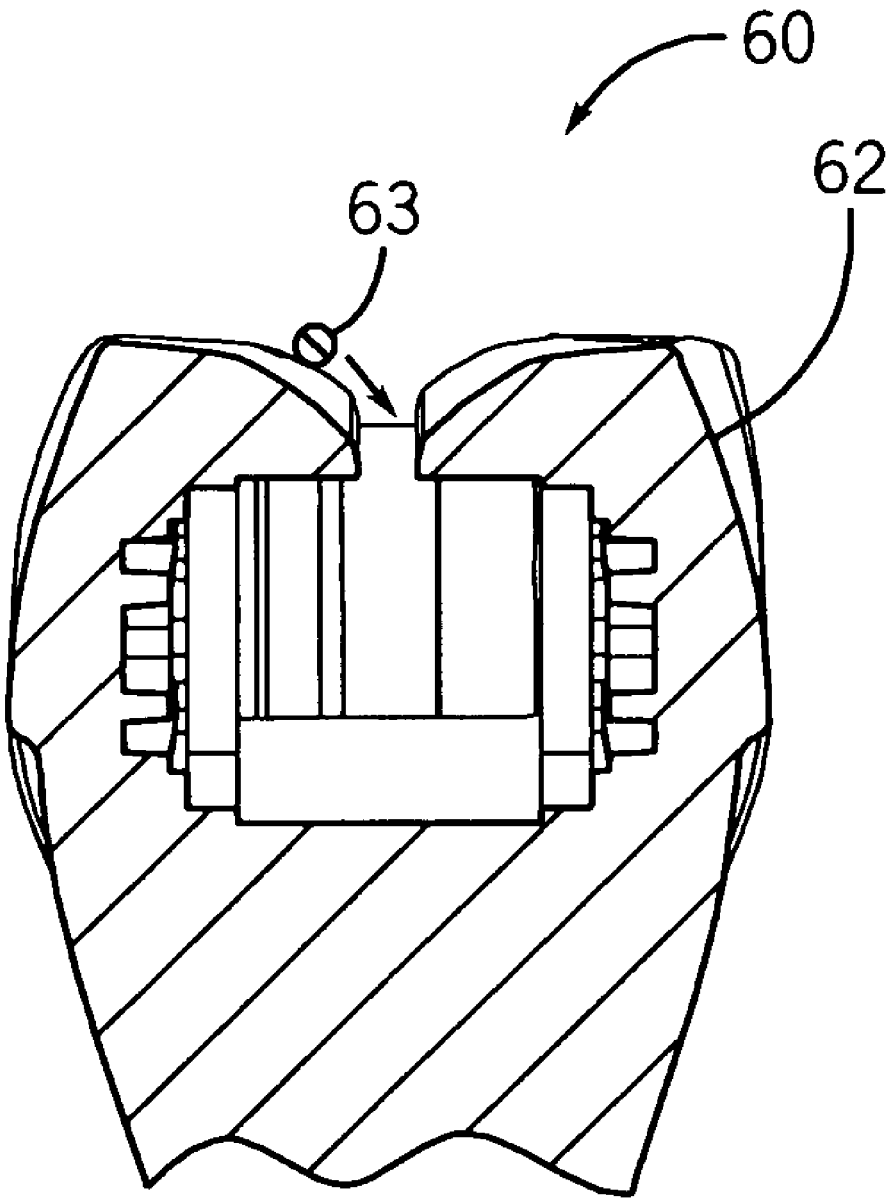
FIG. 11B is a cross-sectional view of the string puller head of FIG. 11A, taken along line 11-11.

As illustrated in detail in FIG. 11A, the string puller head 56 may include a self-guiding tension puller 60. More particularly, as depicted in FIG. 11B, the self-guiding tension puller 60 has a tapered housing 62. Consequently, when a user is feeding the string 63 into the tension puller 60, little or no alignment is required on behalf of the user, since the angle of the tapered housing 62 automatically guides the string 63 into the grip of the tension puller 60, as indicated by the arrow in FIG. 11B.

The stringing machine 20 may also include a control assembly housing 64 coupled to the stringing platform 26, with the control assembly housing 64 being capable of tilting along with the stringing platform 26. The control assembly housing 64 may be formed primarily of die-cast aluminum. In fact, any or all of the major components of the stringing machine 20, namely the base 22, stand 24, and stringing platform 26, may be formed of die-cast aluminum or other metal, wood, plastic, high-strength polymer, composite materials, or any combination of these materials, for example.

Figure 9:
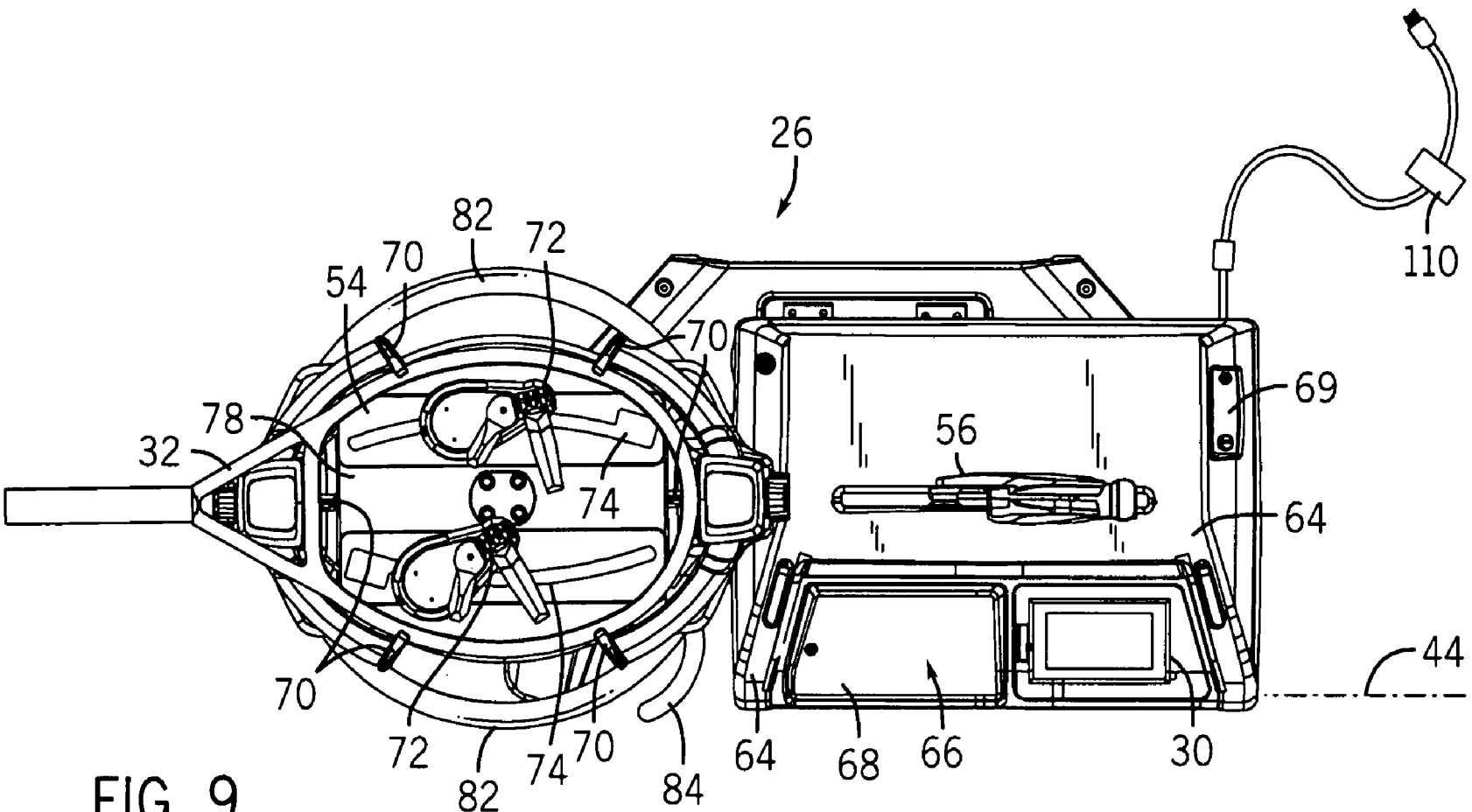
FIG. 9 is a top view of a racquet stringing machine.
Figure 10:
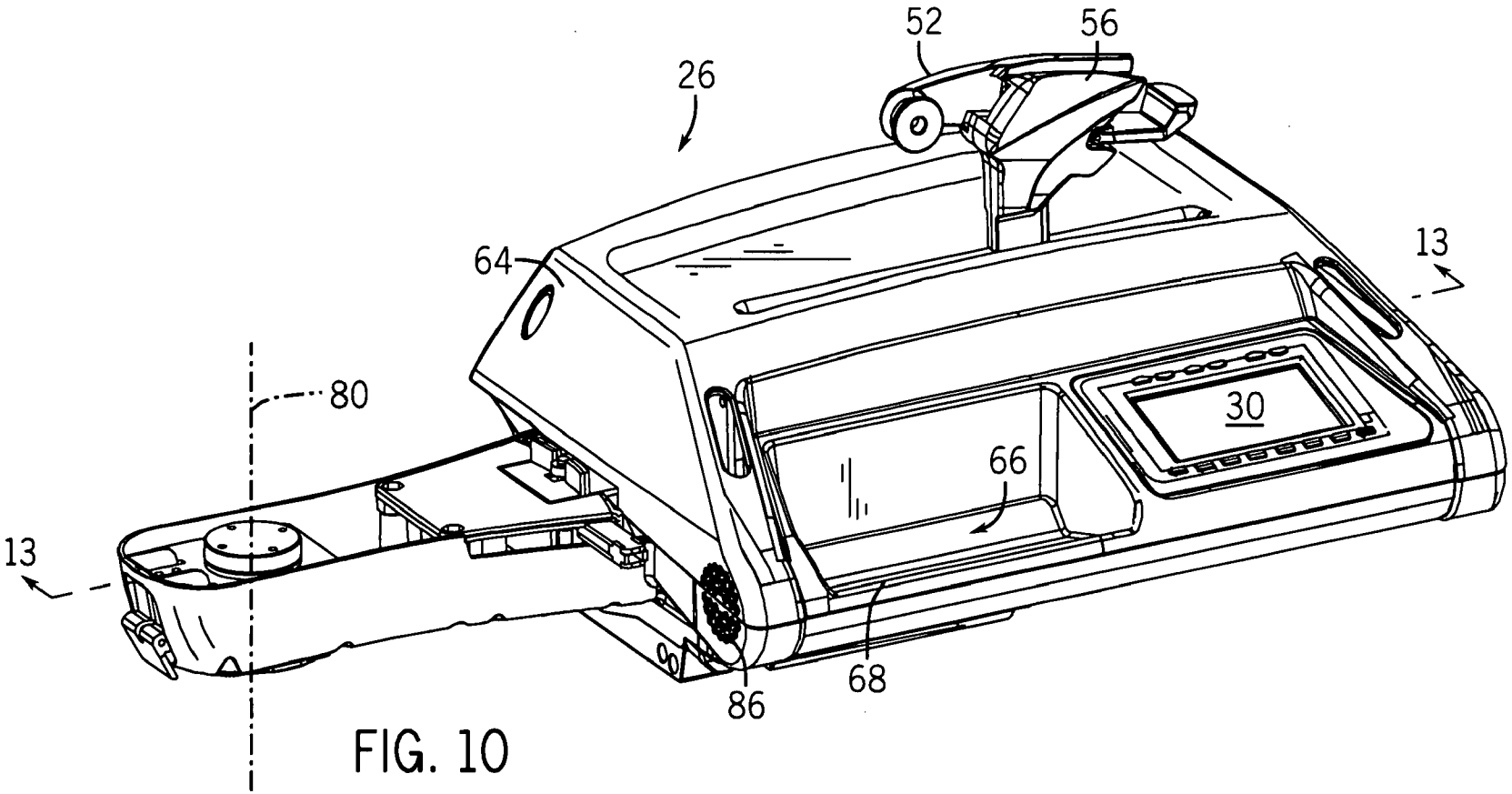
FIG. 10 is a perspective view of a stringing platform.

The control assembly housing 64 may define a tool storage region 66, as shown in FIGS. 9 and 10, that is shaped to retain tools in all stringing plane positions of the stringing machine 20. The tool storage region or tool storage tray 66 may have a bottom surface 68 lying in a plane that is non-parallel with the stringing plane 40. For example, the bottom surface 68 of the tool storage tray 66 may lie in a plane that is approximately parallel with the horizontal surface while the stringing plane 40 is tilted. As a further example, the bottom surface 68 of the tool storage tray 66 may lie in a plane that is at an angle of about 1 to about 15 degrees from the stringing plane 40. Alternatively, the tool storage tray 66 can be configured in other recessed shapes for retaining tools in all stringing plane positions. Additionally, the control assembly housing 64 may also define an additional storage region 69, shown in FIGS. 1 and 9, suitable for holding a PDA or an MP3 player, for example.

Figure 14:
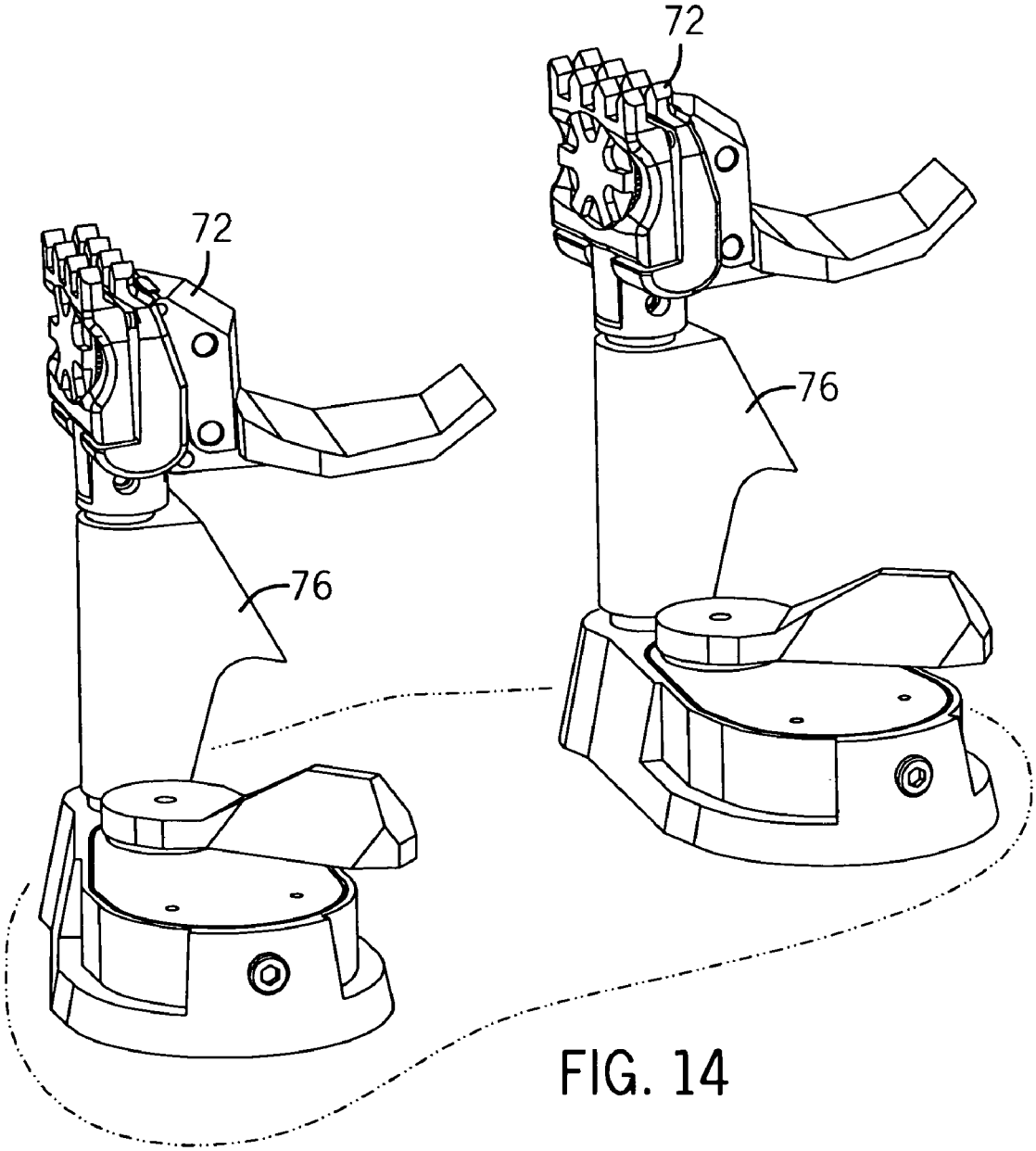
FIG. 14 is a perspective view of string clamp having an over-molded grip.

As illustrated in FIGS. 1 and 9, the stringing platform 26 includes multiple frame clamps 70 for maintaining the frame of a racquet 32 in place on the turntable 26, and at least one string clamp 72 for maintaining the strings in place during the stringing process. The string clamps 72 can be positioned and repositioned within the stringing plane 40. For example, the string clamps 72 can be slid and rotated within curved slotted tracks 74 illustrated in FIG. 9. The string clamps 72 may be conventional string clamps; alternatively, the string clamps 72 may each have an over-molded grip 76 on a shaft of the string clamp 72, as illustrated in FIG. 14. The over-molded grip 76 is preferably a replaceable slip-on, ergonomically-shaped adapter that provides enhanced comfort to the user, and is suitably formed substantially of rubber. The over-molded grip 76 may also be formed of materials other than rubber, such as any suitable thermoplastic polymer. The over-molded grip 76 featured on the string clamps 72 in FIG. 14 can be applied to string clamps having a lock lever as well as string clamps having a squeeze-to-release pivot. FIG. 14 illustrates one preferred shape for the over-molded grip 76. In alternative embodiments, other ergonomically desirable shapes can be used. It is contemplated that the string clamp 72 is configured to receive and function with a number of over-molded grips having varying shapes, thereby allowing the string clamps to be customized to a particular user or application. The over-molded grips 76 may be interchangeable, meaning that a single string clamp 72 may accept a variety of different grips, such that each user may place their preferred grips 76 on the string clamps 72 during any given stringing session.

Another feature that may be present on the stringing platform 26 is a dark or black surface on a racquet-facing surface 78 of the stringing platform 26. The dark surface enables the user to see the string more easily during the stringing process. A racquet-facing surface 78 is indicated in FIG. 9 in a non-darkened state for purposes of clarity.

The turntable 54 may be rotatable about a generally vertical axis 80 (see FIG. 10). The axis 80 is positioned in a generally vertical orientation when the stringing platform 26 is in an un-tilted position, and the axis 80 tilts in conjunction with the stringing platform 26, such that the axis 80 is generally perpendicular with the stringing plane 40. The turntable 54 allows the racquet 32 to spin in a plane parallel to a plane in which the turntable 54 lies, thereby allowing a user to adjust the angle of the racquet 32 as necessary, particularly when transitioning from stringing the main strings to stringing the cross strings.

Additionally, the turntable 54 may include a ring 82 centered about the axis 80, with a releasable resistance assembly 84 configured to releasably engage, and disengage, the ring 82 to prevent rotation of the turntable 54 about the axis 80, as illustrated in FIG. 9. More particularly, the mechanism of the releasable resistance assembly 84 may be similar to a bicycle brake, with a lever operated by the user at one end and the opposite end designed to contact the inner surface of the ring 82 when the brake is applied, thus creating sufficient friction to prevent the turntable 54 from rotating. The releasable resistance assembly 84 is configured to enable a user to quickly and easily engage and lock the turntable 54, thereby preventing rotation of the turntable, and enabling release of the turntable as needed during use. This releasable resistance assembly 84 can bring the turntable 54 to a stop in mid-rotation.

Figure 12A:
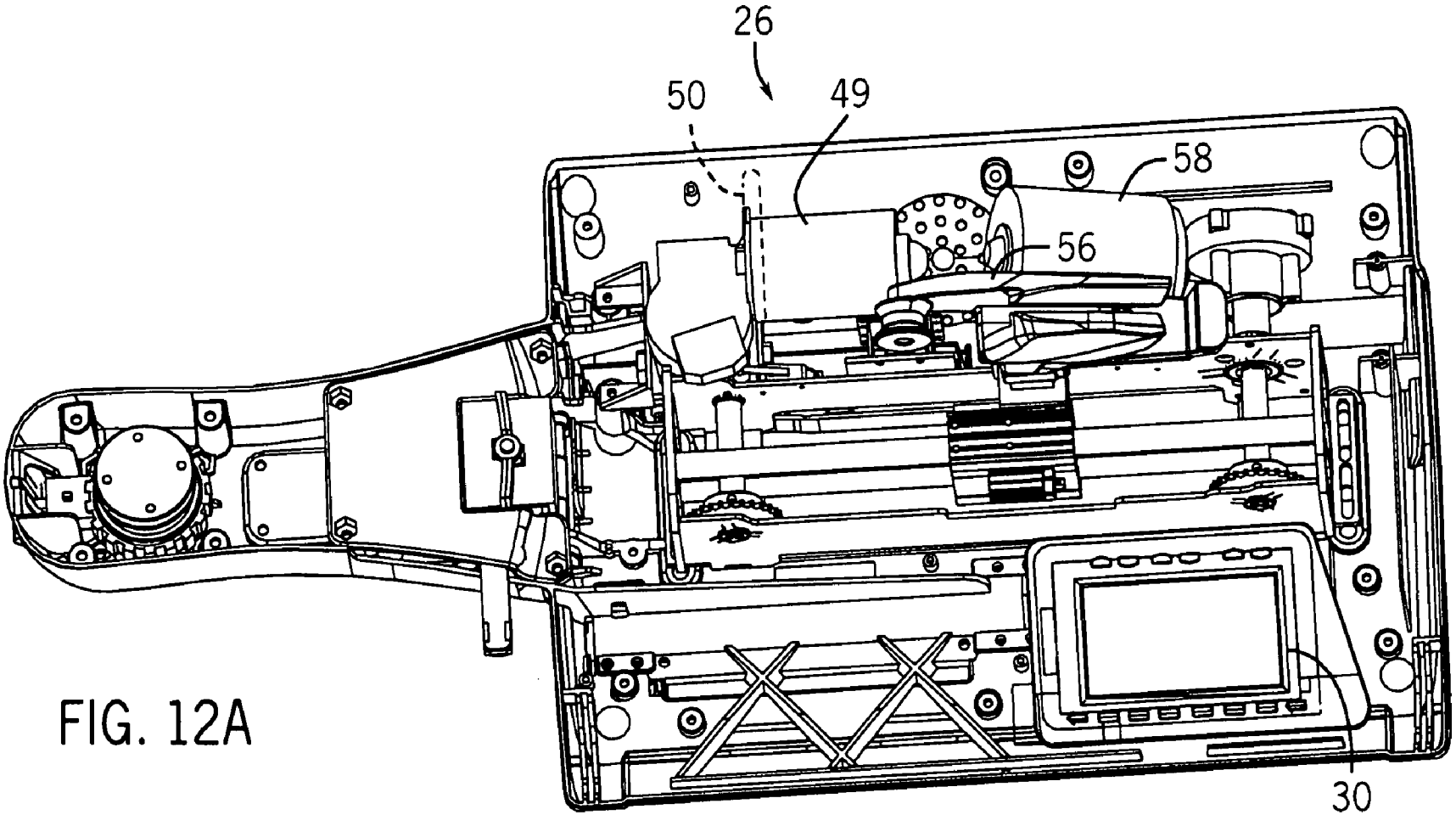
FIG. 12A is an interior view of a stringing platform as viewed from the top.
Figure 12B:
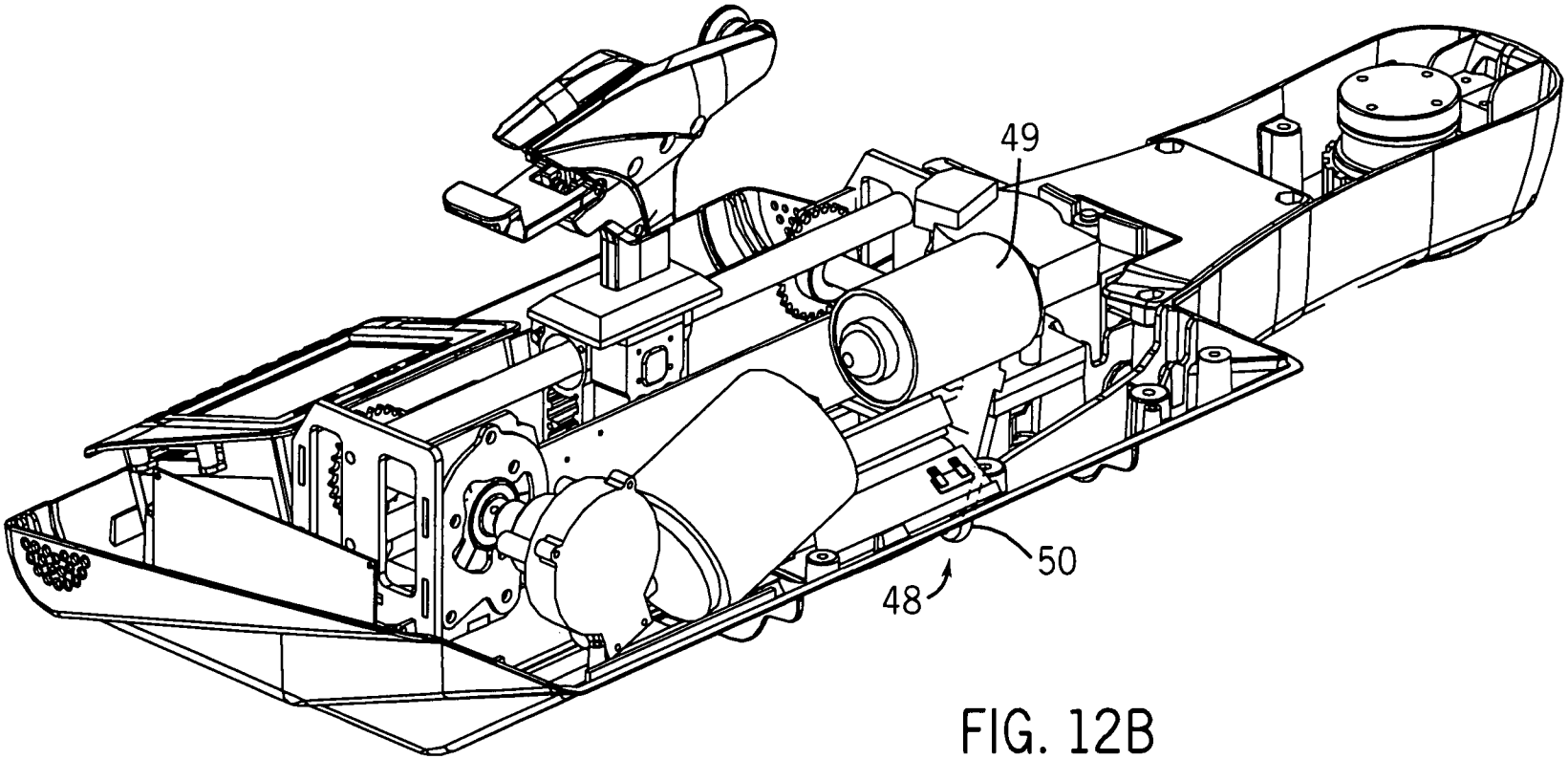
FIG. 12B is an interior view of a stringing platform as viewed from the rear.
Figure 12C:
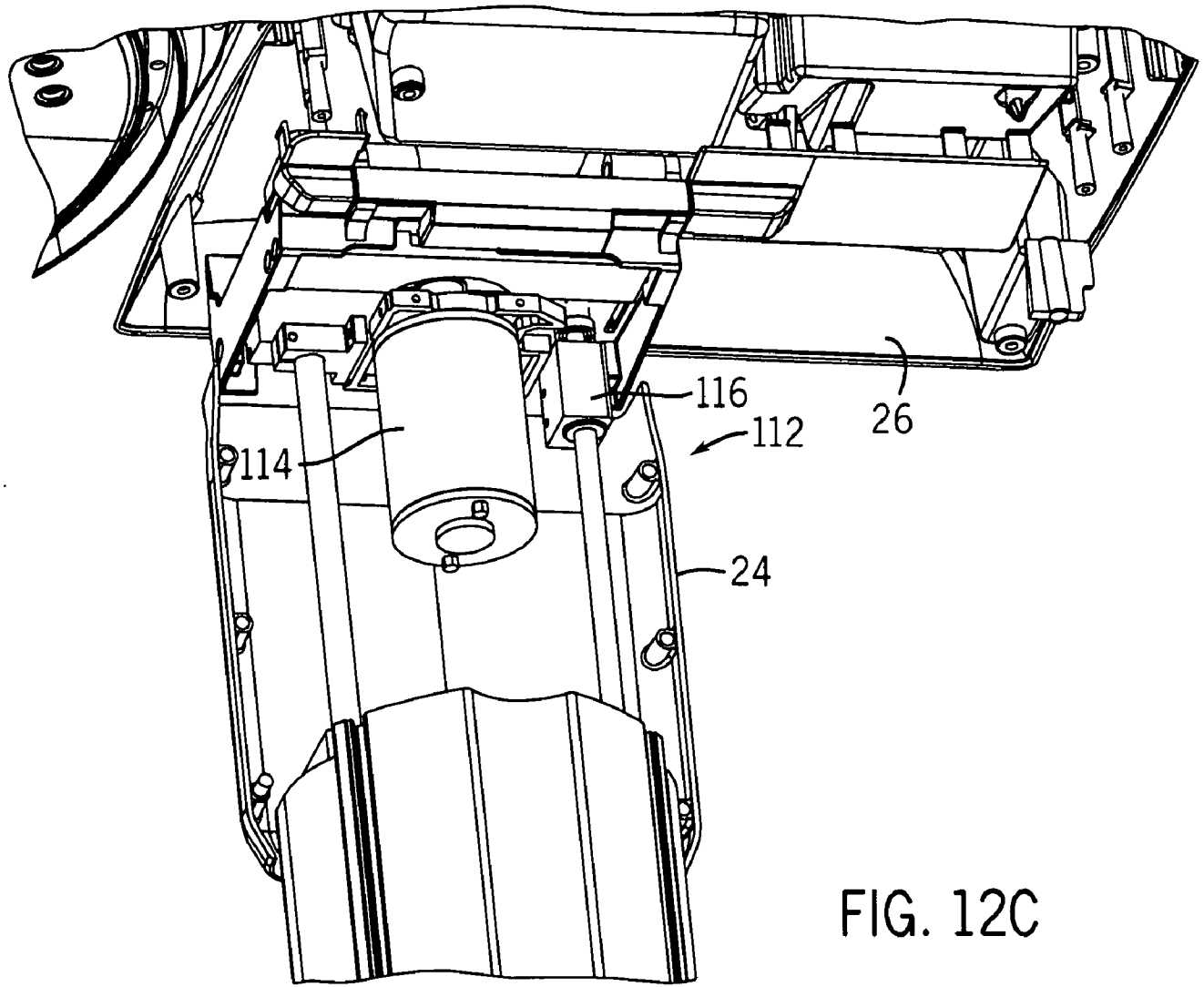
FIG. 12C is an interior view of a stand at its connection to a stringing platform.
Figure 13:
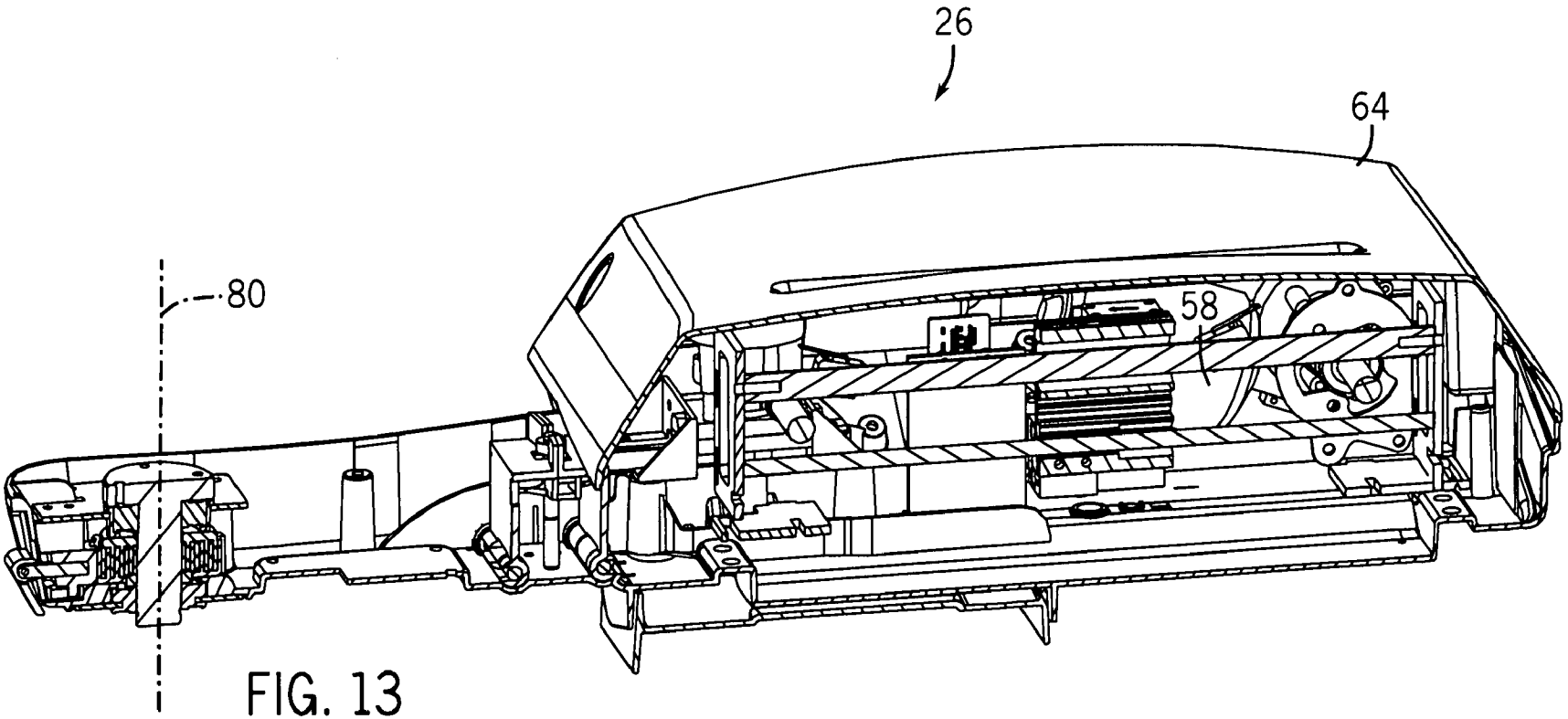
FIG. 13 is a cross-sectional view of the stringing platform of FIG. 10, taken along line 13-13.

In another embodiment, illustrated in FIG. 12C, the stringing machine 20 includes a height adjustment assembly 112 coupled to the stand 24, the stringing platform 26, and/or the base 22, and a control unit 30 operably coupled to the height adjustment assembly 112. In this embodiment, the control unit 30 is capable of generating a first control signal to the height adjustment assembly 112 to automatically adjust the height of the stringing machine 20 based upon a selected user profile. The height adjustment assembly 112 can adjust the height of the stringing machine 20 in response to the first control signal by a distance within the range of 0.25 inches to 24 inches, for example. In certain embodiments, the height of the stand 24 may be manually adjustable. Various heights of the stringing machine 20 are illustrated in FIGS. 4, 6, and 8. The height adjustment assembly 112 may include a height adjustment motor 114 coupled to the stand 24, with the height adjustment motor driving a gear assembly 116 to adjust the height of the stringing machine 20, as illustrated in FIG. 12C. The gear assembly 116 may include a threaded rod, as illustrated in FIG. 12C. Alternatively, the gear assembly 116 may drive a chain that runs in a track within the stand 24, or a screw drive may raise and lower the height of the machine 20, for example. As with the drive mechanisms used to tilt the stringing platform 26, those skilled in the art are familiar with a variety of suitable drive mechanisms that would be appropriate for raising and lowering the height of the stringing machine 20. Therefore, the details of such mechanisms will not be described in greater detail herein.

As mentioned, the stringing machine 20 may include an electronic control unit 30 (FIG. 1) operably coupled to the stringing platform 26, wherein the control unit 30 is capable of storing one or more user profiles and generating a first control signal to automatically adjust at least one parameter of the machine 20, such as machine height, angle θ of stringing platform 26, or string tension, based upon a selected user profile.

In particular, the user profile may include the user's height, a preference for metric or English units, a language preference (English, Spanish, French, German, etc.), string tension indication preferences (visual, auditory, or both) including main string stringing tension, cross string pulling tension, knot tension, and the rate at which the tension is applied to the string, stringing pattern preference, pre-stretch preference, and/or any other specified preferences. For example, the user may input his or her height in response to which the electronic control unit 30 may activate the drive mechanism to automatically adjust the height of the stand 24 to achieve a preferred height of the stringing platform 26 based on pre-programmed data correlating user height with a comfortable turntable height. After clamping the racquet 32 in place, the user may press a button on the electronic control unit 30 in response to which the electronic control unit 30 may then activate another drive mechanism to automatically adjust the angle θ of the stringing platform 26 to achieve a preferred angle of the stringing platform 26 also based on pre-programmed data correlating user height with a comfortable turntable height and angle at which to string the racquet 32. This pre-programmed data may be derived from anthropometric surveys, for example.

In a preferred embodiment, the racquet stringing machine 20 is positionable between at least a main stringing position and a cross string stringing position. The main stringing position includes a first predetermined height and a first predetermined angle between the stringing plane and the horizontal surface. In one particularly preferred embodiment, the first predetermined height, which is the distance between the horizontal support surface and the height of the stringing plane (when positioned horizontally), is approximately 42 to 45 inches, and the first predetermined angle is approximately 10 degrees.

The cross string stringing position includes a second predetermined height and a second predetermined angle between the stringing plane and the horizontal surface. The second predetermined height is different from the first predetermined height, and wherein the second predetermined angle is different from the first predetermined angle. In one particularly preferred embodiment, the second predetermined height, which is the distance between the horizontal support surface and the height of the stringing plane (when positioned horizontally), is approximately 45.1 to 51 inches, and the first predetermined angle is approximately 12-15 degrees.

The racquet stringing machine 20 can also be positionable in a racquet mounting position, and the racquet mounting position includes a third predetermined height and a third predetermined angle between the stringing plane and the horizontal surface. The third predetermined angle is different from the first and second predetermined angles, and the third predetermined height is different from the first and second predetermined heights. In one particularly preferred embodiment, the third predetermined height, which is the distance between the horizontal support surface and the height of the stringing plane (when positioned horizontally), is approximately 40-41 inches, and the first predetermined angle is approximately 0 degrees, such that the racquet is horizontal when mounted onto the stringing machine. The values of the first, second and third predetermined heights and the first, second and third predetermined angles are entirely configurable and can be adjusted or varied to accommodate a particular application, user or group of users. The amounts listed above are examples only, and are not intended to be limiting.

Figure 15A:
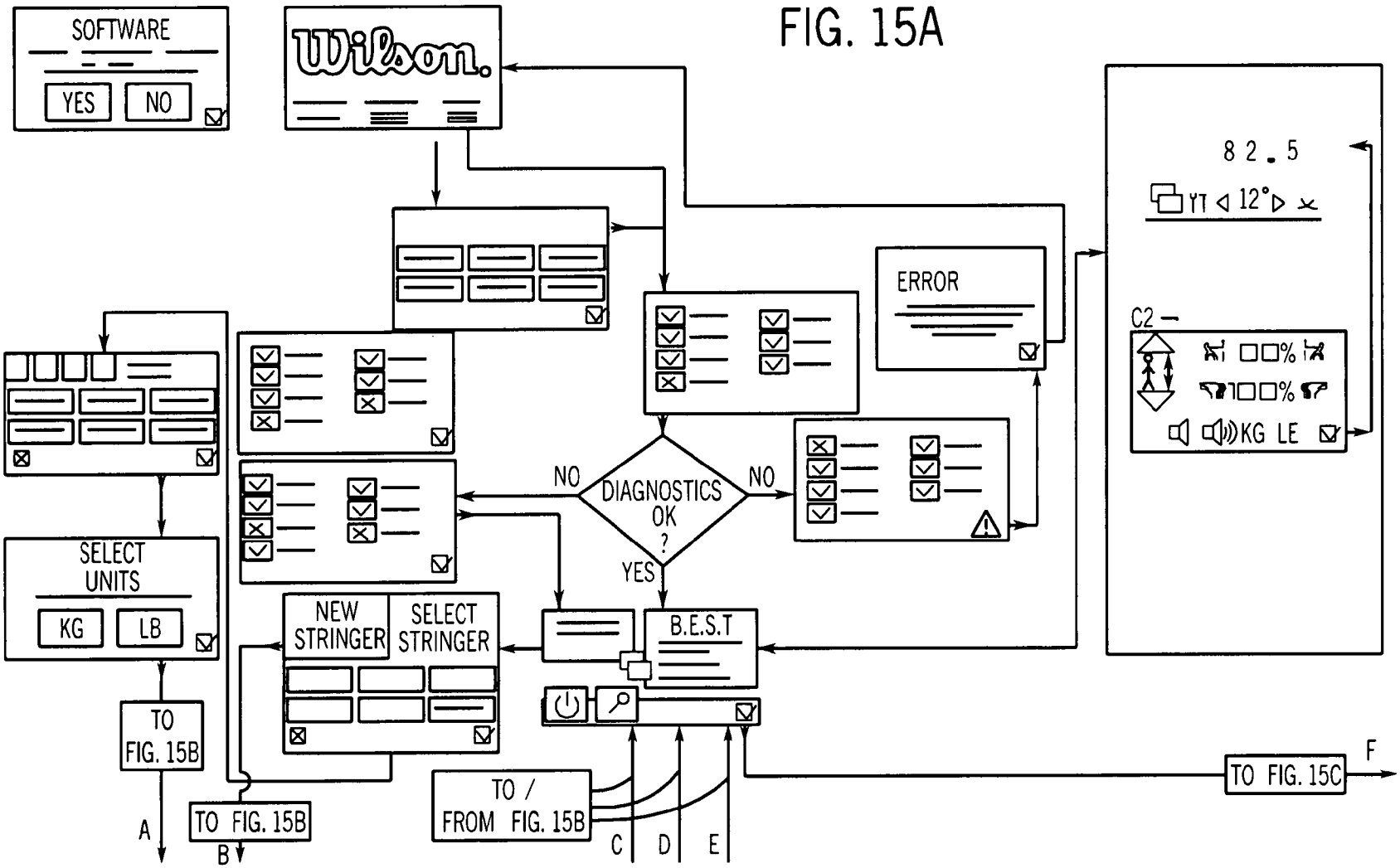
FIG. 15 is a block diagram of screen displays associated with the control unit.
Figure 15B:
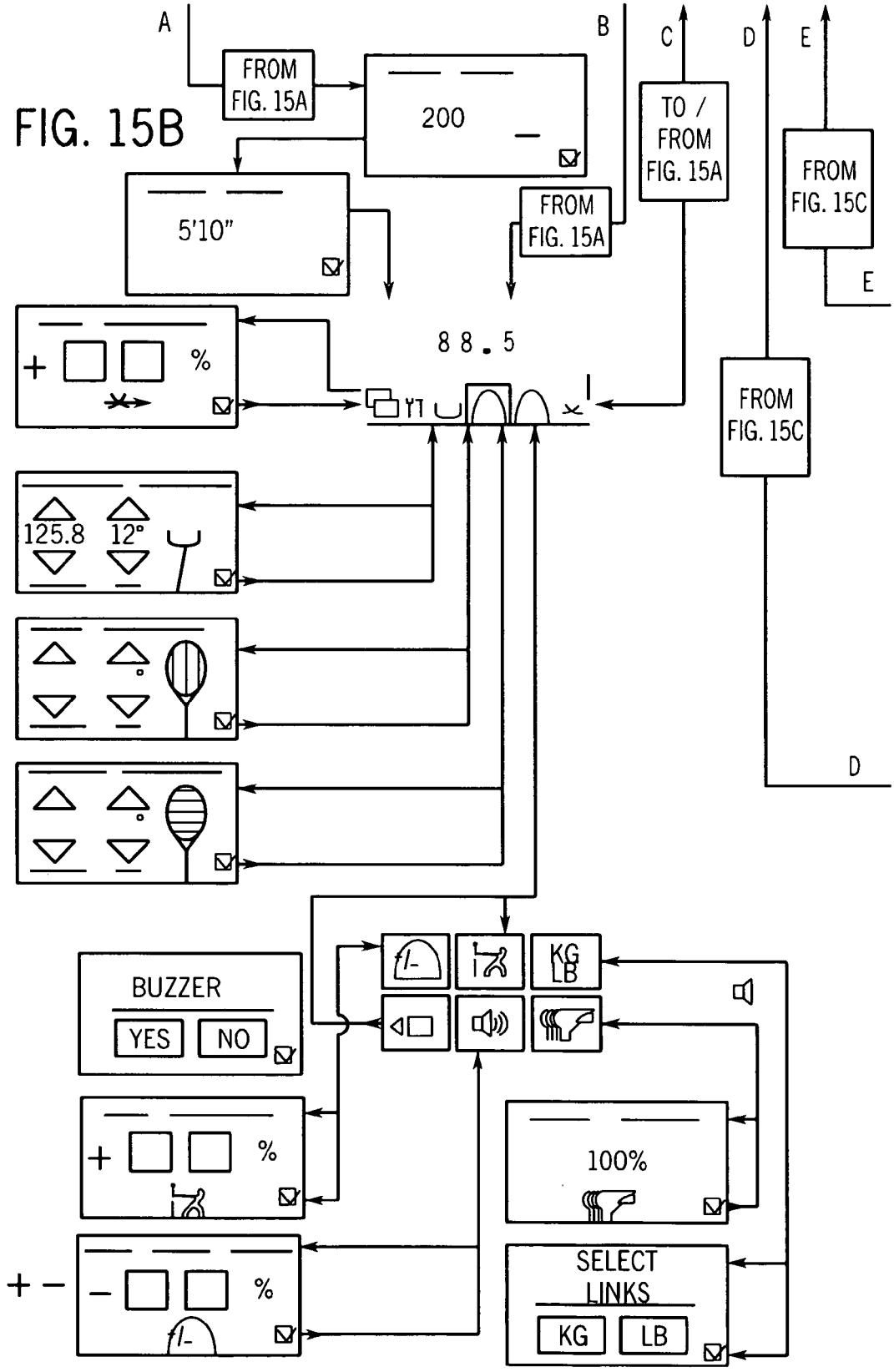
Figure 15C:
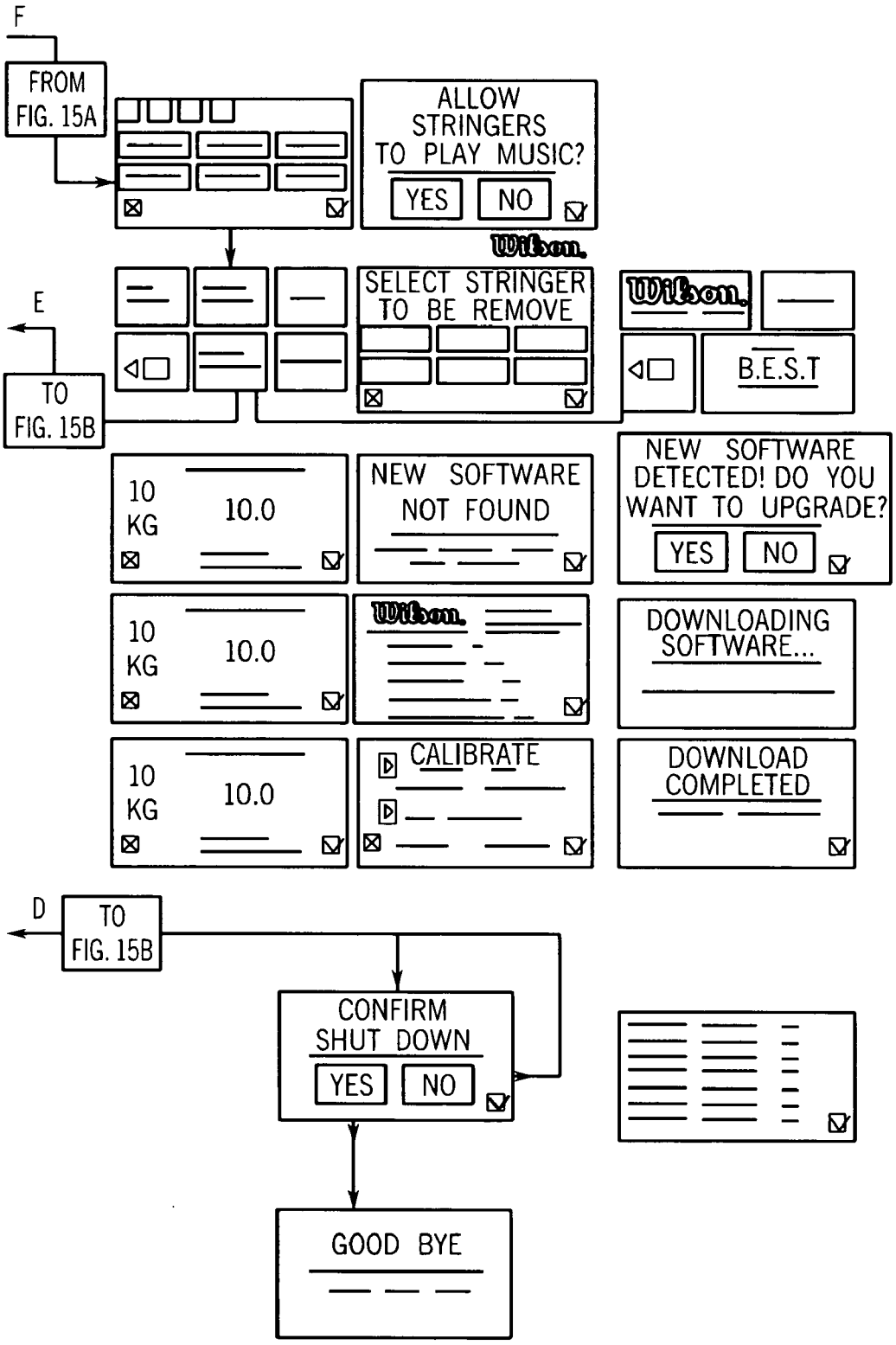
Figure 16:
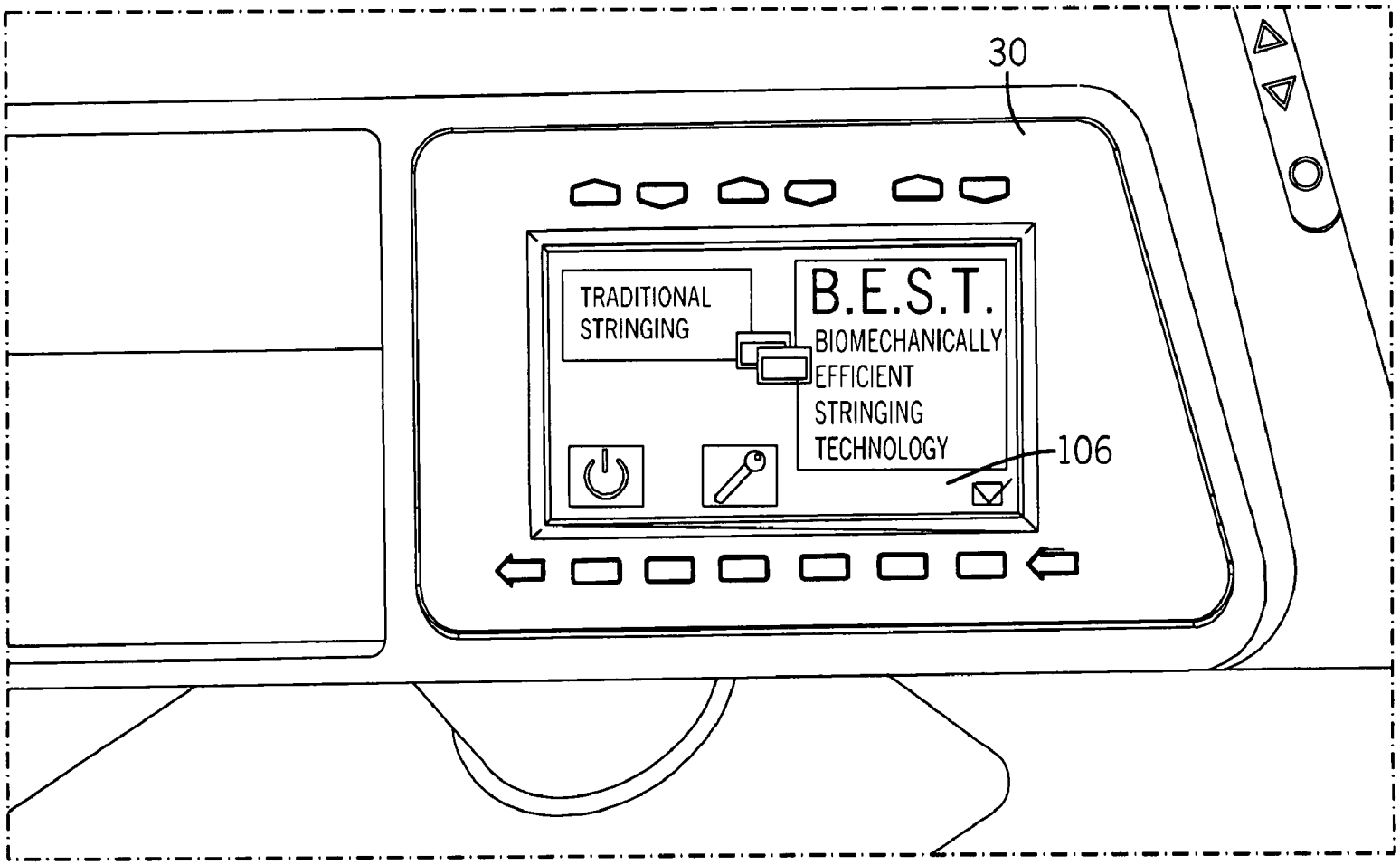
FIGS. 16-20 are individual screen displays each associated with the control unit.

The block diagram in FIG. 15 illustrates a variety of screen displays that may be prompted by the control unit. As shown, the control unit 30 may begin by requesting data and user preferences from a particular user, such as asking the user to select a language. The control unit 30 may be pre-programmed to function in one or more languages, for example, in English, Spanish, German, French, Italian, and Japanese. Subsequently or alternatively, the control unit 30 may perform a diagnostics check, followed by self-calibration. FIG. 16 illustrates an example of a screen display that may appear following a successful diagnostics check. As indicated in FIG. 16, the user may have the option of using the stringing machine in a traditional manner, namely without any automatic adjustments of any of the machine parameters.

Figure 17:
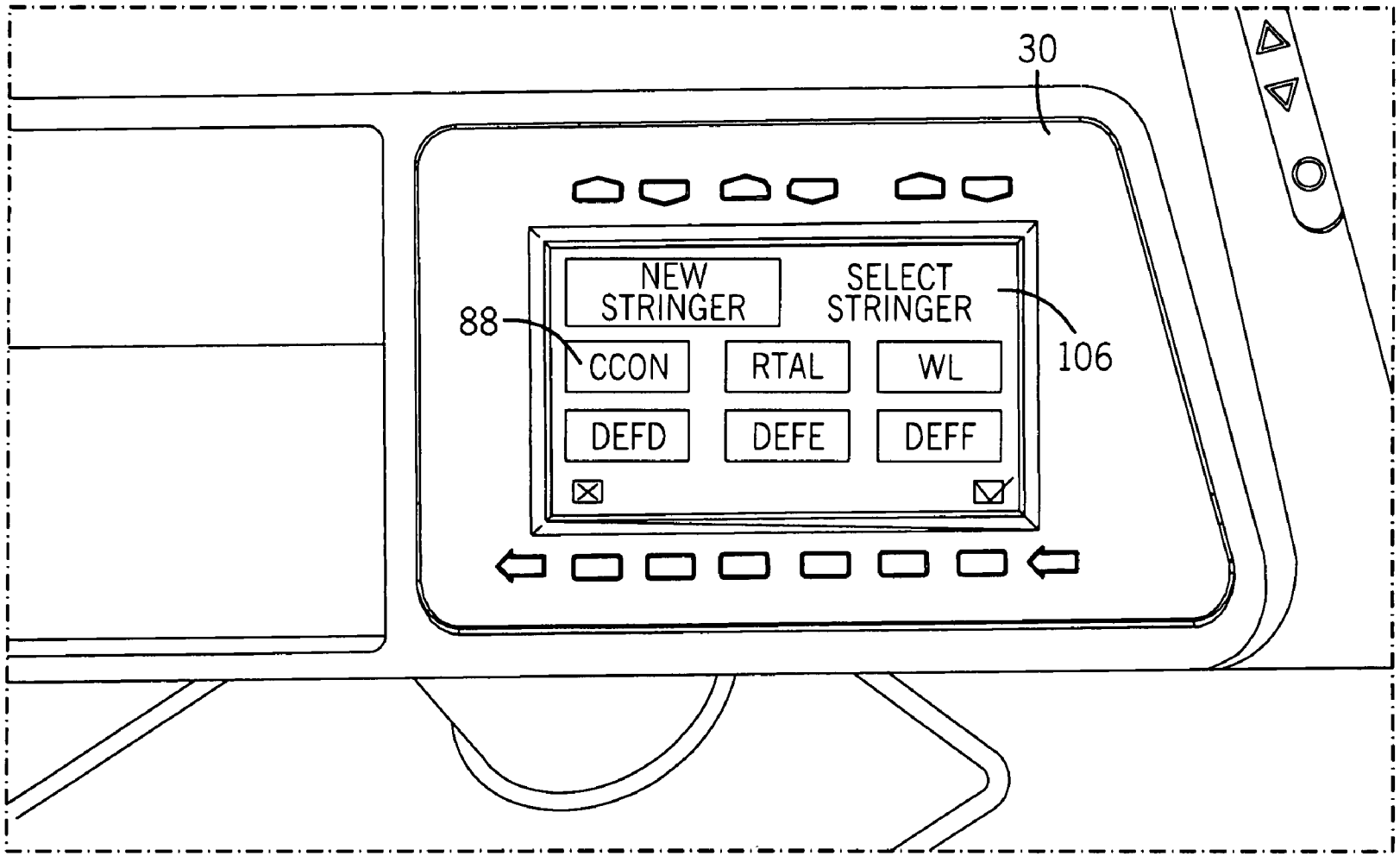
Figure 18:
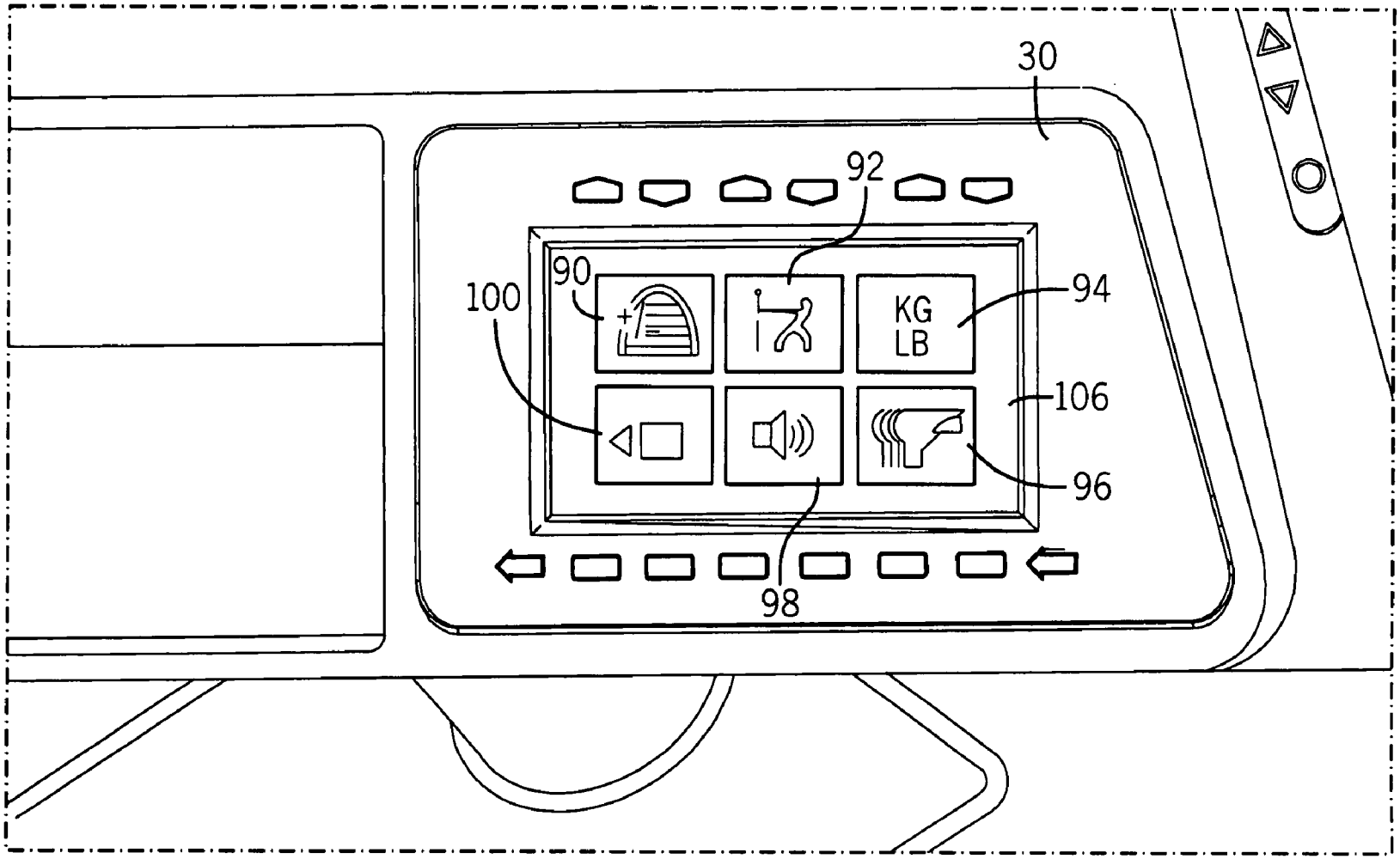

FIG. 17 illustrates an example of a screen display associated with the selection of a user profile. If one or more user profiles is already set up, the user may select his or her profile by touching the appropriate region of the screen display such as region 88 for a particular user and have the control unit 30 adjust the stringing machine 20 accordingly. Each user may use a different language, if desired. If the user is a new user, a new profile may be set up. Alternatively, for returning users, the machine will default to the programmed preferences of a particular. Further, one or more features of the automated systems may be overridden and manual adjustments may be made, if desired, either before or during the stringing process. As another alternative, one or more pre-set profiles may be provided as options that are available to any user. FIG. 18 illustrates an example of a screen display providing the user with a variety of preferences that may be set up or changed, such as cross-string and main-string tension preferences 90, pre-stretch preferences 92, metric/English unit preferences 94, tension puller speed preferences 96, string tension indication preferences 98, and knot tension preferences 100. The option to override settings may be available at essentially every stage of the stringing process.

The personal profiles may be stored by the user's initials, and may include the user's height, language preference, metric/English units preference, a preference of displaying either target tension or real-time (i.e., ramping up) tension while the machine is tensioning the strings, a preferred knot tension, a pre-stretch preference, same or reduced tension in the cross strings preference, tournament settings, or other stringing pattern preference. For example, some users may opt to have increased tension in the string when tying the knot, with the last string being pulled at 5-10% greater tension. The increased knot tension allows the string to relax a bit after the knot is tied, thus resulting in a tension in the last string that is essentially equivalent to the tension in the other strings.

Figure 19:
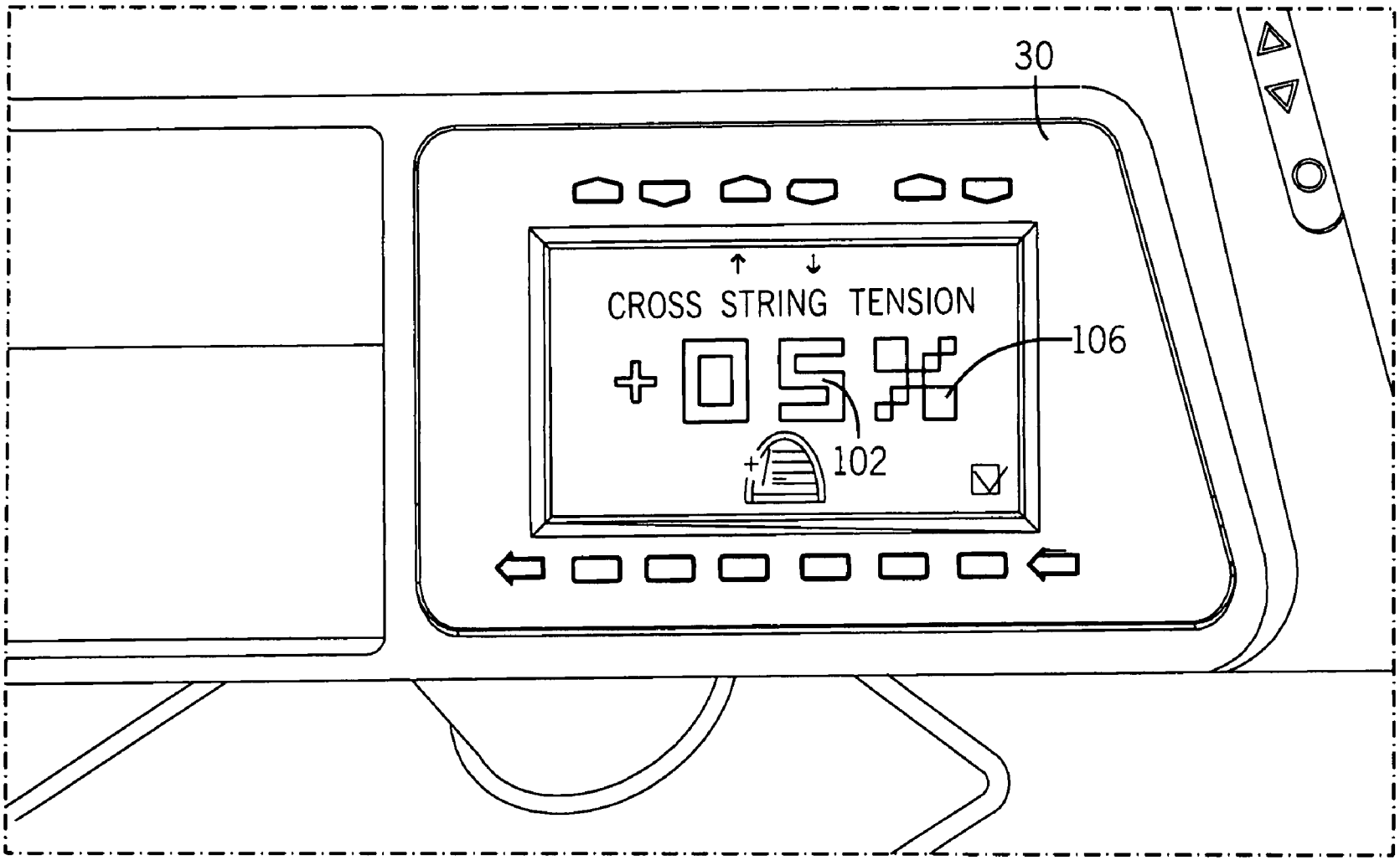
Figure 20:
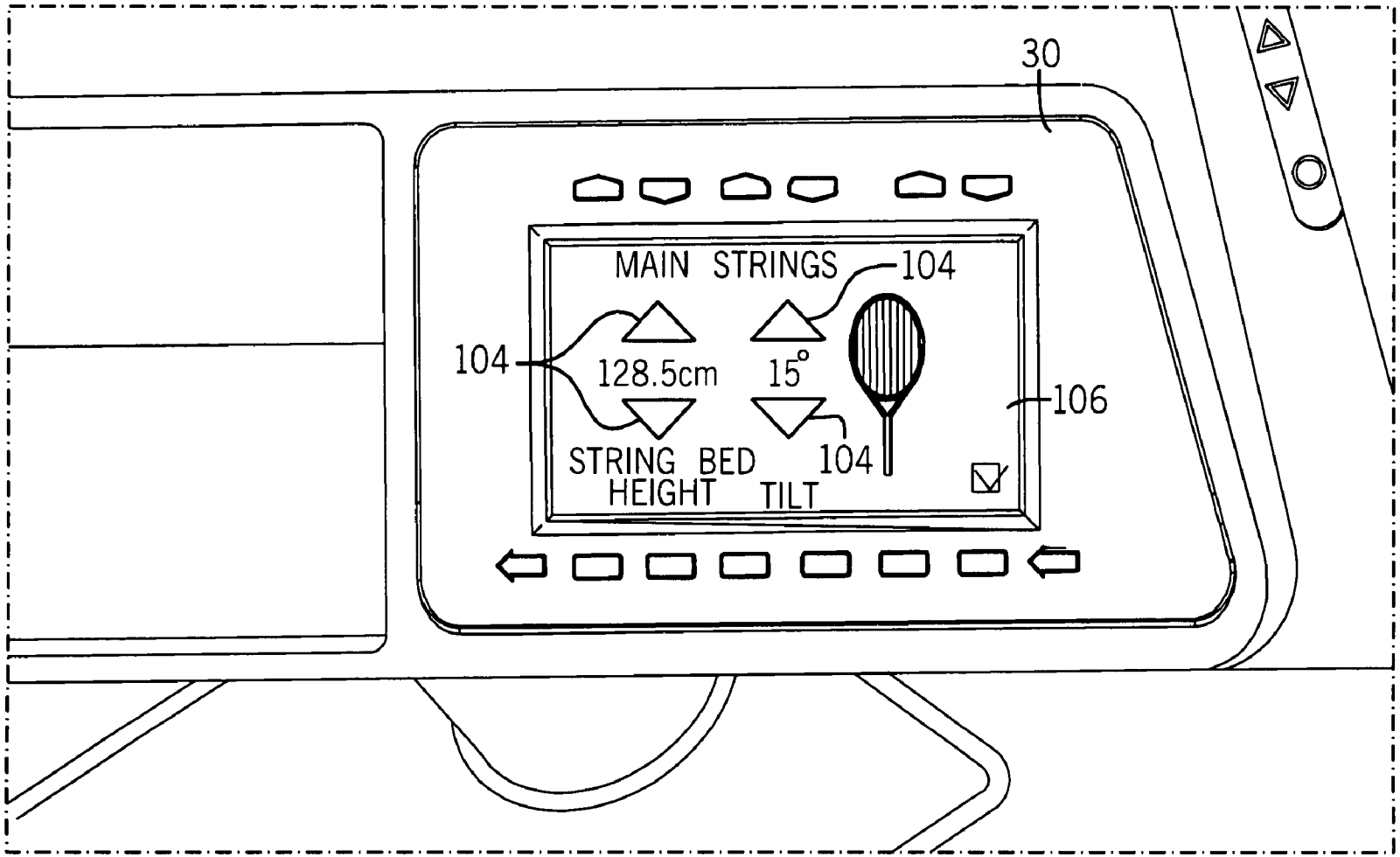

Many users opt to have a stringing machine pre-stretch the strings, with up to about 20% more tension, which is carried out by a slow stretch followed by faster stretching. For example, the pre-stretching procedure may include an initial pull with 10% more tension, namely with an initial pull to 55 pounds (lbs.), followed by relaxation, and then a subsequent pull to 50 lbs. As another example, the pre-stretch procedure may include an initial pull to 55 lbs., followed by a pull to a lower amount such as 30 lbs., followed by a pull back to 55 lbs. The actual stretch amounts may be customized by the user. Pre-stretching typically results in a more accurate and sustainable tensioning of the strings. Many users also opt to have the cross strings strung at a lower tension, such as about 2 lbs. lighter than the main strings, which equalizes the face of the racquet 32 and also facilitates removal of the racquet 32 from the stringing machine 20 upon completion of the stringing process. Additionally, the control unit 30 may provide the user with the option of adjusting the tension during one or more steps in the stringing process. As illustrated in FIG. 19, the display may include a touch pad on which the user can adjust tension settings by pressing on upper or lower portions of the displayed number 102. For example, in FIG. 19, if a user touches the upper portion of the number "05" as displayed on the display screen, the displayed value and the level of tension will increase. Likewise, if a user touches the lower portion of the number "05" in FIG. 19, the displayed value and the level of tension will decrease to "04%" or "03%" or whatever value the user selects. As illustrated in FIG. 20, the user may also adjust the position of the stringing platform 26 during various steps of the stringing process by pressing arrows 104 up or down.

Other options available to the user may include options for indicating that the target tension has been reached. For example, a load cell 108 (FIG. 21) can produce a signal that results in beeping or other auditory indicator, flashing lights such as along beveled edges with an LED or other visual display, both audio and visual indicators, or simply having the machine stop at the target tension. The user may elect a single tension notification signal of their choice, or any two or more of the signals to be used simultaneously. Additionally, the user may be able to adjust the level of the indicator, such as the volume of an auditory indicator or the brightness of a visual indicator.

The control unit 30 may also include software that is capable of tracking the number of string pulls performed by a particular user over a particular time interval, the amount of time it takes to string each racquet, the number of racquets strung, and the average time it takes to string each racquet. Accordingly, the control unit 30 can be used to record the stringing history of the stringing machine 20 as a whole, or that of particular users. Such information could potentially be used to gauge the duration of a particular racquet stringing period, the productivity of a particular stringer, and/or the overall use of the machine.

Figure 21:
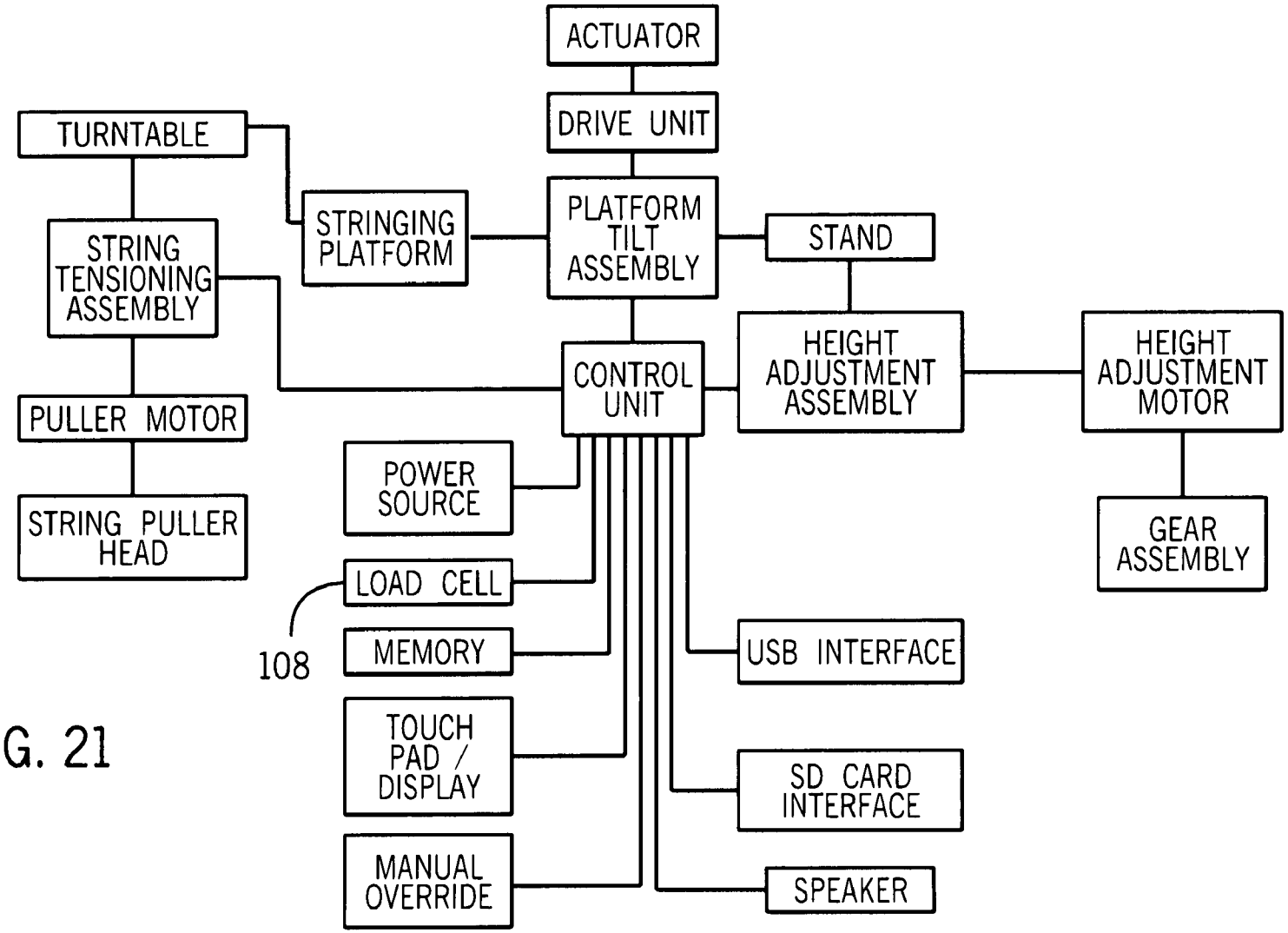
FIG. 21 is a block diagram of control unit features.

The electronic control unit 30 may contain a variety of additional features that enhance the functionality of the machine 20. For example, the unit 30 may include a universal serial bus (USB) interface that is compatible with such devices as MP3 players, speakers, personal digital assistants (PDAs), gaming devices, and virtually any other device with a USB connector. Additionally, the unit 30 may include a USB to SD card reader, or SD card interface. With an SD card reader, a program on the card can be run when the card is present, and when the card is removed the main computer within the control unit 30 will be the program source. The SD card reader can be used to correct programs and upgrade software, thus allowing the control unit 30 to be updated without the need to replace the entire stringing machine 20, or even the entire electronic control unit 30. The control unit 30 may also include one or more built-in speakers 86, A/V jacks, and/or a pocket with a speaker jack. Another feature that may be present on the control unit 30 is a touch-panel interface 106, as illustrated in FIGS. 16-20, thus providing a smooth surface with no raised buttons on the control panel. FIG. 21 is a block diagram illustrating how various features of the stringing machine 20 may be connected to the control unit 30.

Figure 22:
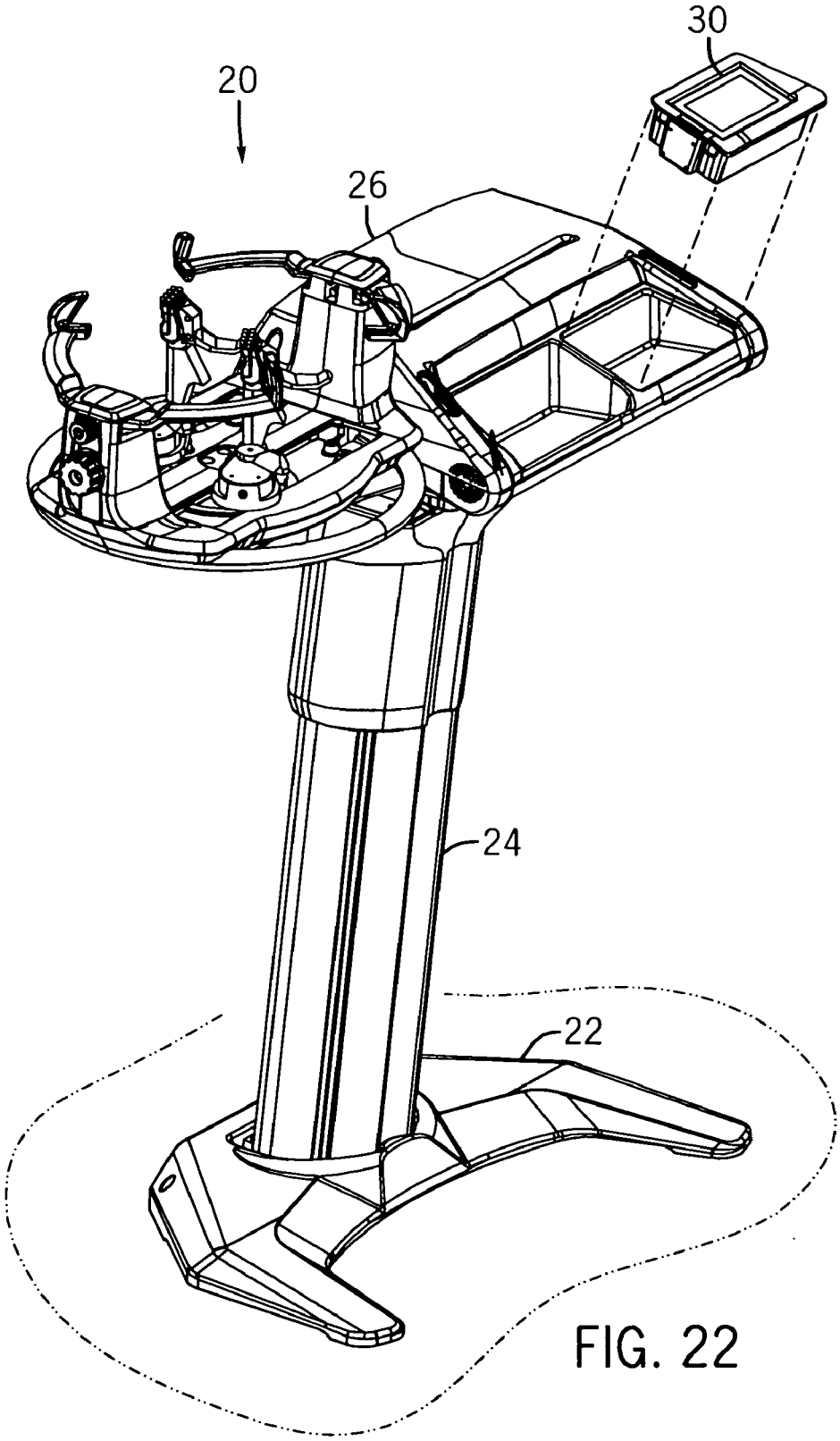
FIG. 22 is a perspective view of a racquet stringing machine showing the fundability of a modular electronic control unit.

As illustrated in FIG. 22, the electronic control unit 30 can be modular. As used herein, the term "modular electronic control unit" refers to a device that can be easily inserted into and removed from the stringing machine 20, as illustrated in FIG. 22, and while inserted can be used to automatically adjust at least one parameter of the machine 20 in response to a user input. Thus, if the modular electronic control unit 30 appears to be malfunctioning, the unit 30 can be easily removed and replaced with another modular electronic control unit 30. The ease of removal of the unit 30 simplifies potential repairs to the machine 20 by allowing the user to remove the unit 30 and ship just the unit 30 to the manufacturer or other repair location, rather than requiring the entire stringing machine 20 to be shipped to the manufacturer or other repair location.

Additionally, the stringing machine 20 may include an external power source 110 operatively attached to the electronic control unit 30, as illustrated in FIG. 9, for example. By locating the power source 110 outside the body of the stringing machine 20, this configuration may facilitate importation procedures concerning approval of electrical devices.

The invention also presents a method of controlling tension in a racquet 32 while stringing a racquet 32 using a racquet stringing machine 20 as described herein. More particularly, the method includes securing a racquet 32 to the stringing platform 26 of a racquet stringing machine 20 and selecting a stored user profile in an electronic control unit 30 operably coupled to the stringing platform 26, in response to which the electronic control unit 30 generates a first signal to automatically adjust tension in the string. As described in greater detail above, the user strings main strings in the racquet 32, guides the string through a tension puller 60, strings cross strings in the racquet 32, and again guides the string through the tension puller 60. The electronic control unit 30 may pre-stretch the string, depending on the user's preferences. As also described above, the user may adjust tension in the string by pressing an adjustment indicator on a display operably connected to the electronic control unit 30.

Any one or more of the stringing machine embodiments described herein may be applied to machines for stringing tennis racquets, racquetball racquets, squash racquets, badminton racquets, and any other strung racquet. In particular, the stringing machine 20 may be used to string racquets for use in an organized professional league and/or in competitive play. Furthermore, the stringing machine 20 may be configured to string racquets in a manner that meets ITF Rules of Tennis requirements for racquet strings. Regardless of the type of racquet 32, compatibility of the stringing machine 20 with the user is greatly improved by using any of the stringing machine enhancements in this invention.

The stringing machine of the present invention provides users with a customized and readily adjustable stringing experience. The stringing machine enables a particular user to position the racquet stringing platform in an optimum position for each portion of the stringing process, thereby reducing stringer fatigue. The stringing machine of the present invention can increase the efficiency of the stringing process. The stringing machine readily adjusts to the preferences of multiple users thereby improving the effectiveness and efficiency of all users.

While the preferred embodiments of the invention have been illustrated and described, it will be appreciated that various changes can be made therein without departing from the spirit and scope of the invention. For example, while the embodiments described herein are illustrated in a stringing machine for stringing a tennis racquet, the principles of the present invention could also be used for stringing machines for stringing practically any other type of racquet. Accordingly, it will be intended to include all such alternatives, modifications and variations set forth within the spirit and scope of the appended claims.

What is claimed is:

1. A racquet stringing machine for stringing of a racquet by a user, the stringing machine comprising:

a base configured to support the stringing machine on a generally horizontal surface;

a stand upwardly extending from the base;

a stringing platform coupled to an upper region of the stand;

a height adjustment assembly coupled to at least one of the stand, the stringing platform and the base; and a control unit operably coupled to the height adjustment assembly, the control unit capable of generating a first control signal to the height adjustment assembly to automatically adjust the height of the stringing machine based upon a selected user profile.

2. The racquet stringing machine of claim 1, wherein the height adjustment assembly adjusts the height of the stringing machine in response to the first control signal by a distance within the range of 0.25 inches to 24 inches.

3. The racquet stringing machine of claim 1, wherein the height adjustment assembly includes a height adjustment motor coupled to the stand, and the height adjustment motor drives a gear assembly to adjust the height of the stringing machine.

4. The racquet stringing machine of claim 1, wherein the control unit is capable of storing at least one user profile and automatically adjusting the height of the stringing machine in accordance with the selected stored profile.

5. The racquet stringing machine of claim 1, wherein the user profile includes at least one of the group consisting of: a height preference, a metric/English preference, a language preference, a tension indication preference, and a pre-stretch preference.

6. The racquet stringing machine of claim 1, wherein the control unit comprises a USB interface.

7. The racquet stringing machine of claim 1, wherein the control unit comprises an SD card interface.

8. The racquet stringing machine of claim 1, wherein the control unit comprises an MP3 player interface.

9. The racquet stringing machine of claim 1, further comprising at least one speaker operably connected to the control unit.

10. The racquet stringing machine of claim 1, wherein the control unit is configured to allow for the automatic height adjustments to be manually overridden.

11. A racquet stringing machine for stringing of a racquet by a user, the stringing machine comprising:

a base configured to support the stringing machine on a generally horizontal surface;

a stand upwardly extending from the base;

a stringing platform coupled to an upper region of the stand, the stringing platform supporting at least one racquet mount for securing the racquet about a stringing plane;

an electronic control unit operably coupled to the stringing platform, the control unit capable of storing at least one user profile, the control unit capable of generating a first control signal to automatically adjust at least one parameter of the machine based upon a selected user profile;

a platform tilt assembly coupled to the stand; and a height adjustment assembly coupled to at least one of the stand, the base and the stringing platform.

12. The racquet stringing machine of claim 11, wherein the racquet stringing machine is positionable between at least a main string stringing position and a cross string stringing position.

13. The racquet stringing machine of claim 12, wherein the main string stringing position includes a first predetermined height and a first predetermined angle between the stringing plane and the horizontal surface.

14. The racquet stringing machine of claim 13, wherein the cross string stringing position includes a second predetermined height and a second predetermined angle between the stringing plane and the horizontal surface, and wherein the second predetermined height is different from the first predetermined height, and wherein the second predetermined angle is different from the first predetermined angle.

15. The racquet stringing machine of claim 14, wherein the racquet stringing machine is also positionable in a racquet mounting position, and wherein the racquet mounting position includes a third predetermined height and a third predetermined angle between the stringing plane and the horizontal surface.

16. The racquet stringing machine of claim 15, wherein the third predetermined angle is different from the first and second predetermined angles.

17. The racquet stringing machine of claim 15, wherein the third predetermined height is different from the first and second predetermined heights.

18. The racquet stringing machine of claim 11, wherein the electronic control unit comprises a USB interface.

19. The racquet stringing machine of claim 11, wherein the electronic control unit comprises an SD card interface.

20. The racquet stringing machine of claim 11, wherein the electronic control unit comprises an MP3 player interface.

21. The racquet stringing machine of claim 11, further comprising at least one speaker operably connected to the electronic control unit.

22. The racquet stringing machine of claim 11, wherein the electronic control unit is configured to allow for the automatic machine adjustments to be manually overridden.

23. The racquet stringing machine of claim 11, further comprising a power source operatively attached to the electronic control unit, wherein the power source is located outside of the body of the stringing machine.

* * * * *